US007380788B2

(12) United States Patent
Ueda et al.

(10) Patent No.: US 7,380,788 B2
(45) Date of Patent: Jun. 3, 2008

(54) SHEET TRANSPORTING DEVICE, SHEET TRANSPORTING METHOD, AND IMAGE RECORDING DEVICE HAVING THE SHEET TRANSPORTING DEVICE

(75) Inventors: Nobuyuki Ueda, Yamatokoriyama (JP); Kenji Takahashi, Yamatokoriyama (JP); Shuhji Fujii, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 265 days.

(21) Appl. No.: 10/947,306

(22) Filed: Sep. 23, 2004

(65) Prior Publication Data

US 2005/0067755 A1 Mar. 31, 2005

(30) Foreign Application Priority Data

Sep. 26, 2003 (JP) ..... 2003-335635

(51) Int. Cl.
*B65H 7/02* (2006.01)

(52) U.S. Cl. ..... 271/265.01; 271/225

(58) Field of Classification Search ..... 271/227–228, 271/265.01, 225
See application file for complete search history.

(56) References Cited

U.S. PATENT DOCUMENTS

| | | | | |
|---|---|---|---|---|
| 5,722,029 | A * | 2/1998 | Tomidokoro et al. | 399/389 |
| 6,758,471 | B2 * | 7/2004 | Hirako | 271/258.01 |
| 7,293,768 | B2 * | 11/2007 | Satoh | 271/258.01 |
| 2002/0127039 | A1 | 9/2002 | Yamagishi | |

FOREIGN PATENT DOCUMENTS

| | | | |
|---|---|---|---|
| JP | 08245003 | A * | 9/1996 |
| JP | 2000-16663 | A | 1/2000 |
| JP | 2001-19253 | A | 1/2001 |

* cited by examiner

*Primary Examiner*—Patrick H. Mackey
*Assistant Examiner*—Jeremy R Severson
(74) *Attorney, Agent, or Firm*—Birch, Stewart, Kolasch & Birch, LLP

(57) ABSTRACT

To provide a sheet transporting device which can control sheet transport also with respect to plural kinds of tab sheets different from each other in terms of a tab position in a vertical direction with respect to a transporting direction without increasing the cost. In case of switching back the tab sheet, a timing for the switch back is controlled in accordance with a timing at which the sheet sensor detects a front end of the tab sheet.

31 Claims, 13 Drawing Sheets

SHEET TRANSPORTING DEVICE, SHEET TRANSPORTING METHOD, AND IMAGE RECORDING DEVICE HAVING THE SHEET TRANSPORTING DEVICE

This Nonprovisional application claims priority under 35 U.S.C. § 119(a) on Patent Application No. 2003/335635 filed in Japan on Sep. 26, 2003, the entire contents of which are hereby incorporated by reference.

FIELD OF THE INVENTION

The present invention relates to a sheet transporting device, provided on a digital copying machine or an image recording device for example, which can carry out reversal transport so as to reverse and transport an image recording sheet, and particularly relates to a sheet transporting device suitable for reversal transport of a tab sheet.

BACKGROUND OF THE INVENTION

Conventionally, there has been used an image forming device provided with a sheet transporting device which can carry out reversal transport so as to reverse and transport a sheet (recording sheet, transcription sheet). Such reversal transport is carried out to stack sheets, on which images have been formed, onto a discharge tray in a desired order (in an order based on a page number) in case of carrying out double-side printing by which images are formed on both surfaces of each sheet or in case of forming images on a plurality of sheets.

For example, in case of carrying out the double-side printing, an image is formed on a front surface of a sheet, and then the sheet is reversed by the reversal transport, so as to form an image on a rear surface of the sheet.

Further, depending on a position in which a sheet having an image is discharged, the sheet may be discharged with its printed surface facing upward when the reversal transport is not carried out. In the case where the sheet is discharged with its printed surface facing upward, there is raised the following problem: when images are sequentially printed on a plurality of sheets, a page order in which discharged sheets are stacked on the discharge tray is inversed. Then, the reversal transport of sheets is carried out, so that it is possible to stack the printed sheets on the discharge tray or the like in a desired page order even in case where images are sequentially printed on the plurality of sheets.

However, such reversal transport has a more complicated mechanism than that of normal single-direction transport, so that this raises such problem that transport failure tends to occur depending on a kind of a sheet used. For example, in case of carrying out the reversal transport of tab sheets each of which has an auriform protruding portion (tab) on its end as shown in FIG. 12, the transport failure is more likely occur than in case of carrying out the reversal transport of normal rectangular sheets.

On the other hand, for example, Patent Document 1 (Japanese Unexamined Patent Publication No. 19253/2001 (Tokukai 2001-19253)(Publication date: Jan. 23, 2001) discloses a technique which relates to a sheet reversing device for carrying out the reversal transport of tab sheets while preventing the transport failure.

The sheet reversing device recited in Patent Document 1 is arranged so that: a movable reversing branch click presses a sheet to be reversed against a carrier roller, and an inverse driving roller inverses a direction in which the sheet having passed through the reversing branch click is carried, thereby carrying out the reversal transport. In case of transporting a tab sheet, a switch back timing at which a transporting direction of the tab sheet is reversed by switching a rotating direction of the inverse driving roller is delayed from a switch back timing of a normal sheet by not less than a time taken for a tab portion to pass through a sheet detection sensor (a time taken to transport a tab portion), thereby preventing transport troubles.

However, the technique disclosed by the Patent Document 1 raises such problem that: when the tab portion is detected by the sheet detection sensor, an extra time taken to transport the sheet at a distance corresponding to a tab width (tab's length in a transporting direction of the sheet) is required.

In the sheet reversing device of Patent Document 1, it is assumed that a distance from a detection position of the sheet detection sensor to the reversing branch click is K1 and a transport speed of the sheet is V1. In case of a sheet other than the tab sheet, the switch back is commenced in a predetermined time expressed by t=K1/V1 after the sheet detection sensor has detected a back end of the sheet. In case of the tab sheet, the timing at which the switch back is commenced is delayed by not less than a time, in which the tab portion is transported, in addition to the predetermined time t. That is, when the tab's length in a transporting direction is L1, the switch back is commenced in a time expressed by t+L1/V1 after the sheet detection sensor has detected a back end of the tab sheet.

Thus, there is no problem in case where the tab portion does not pass through a detection position of the sheet detection sensor. However, in case where the tab portion passes through the detection position of the sheet detection sensor, the tab sheet is excessively transported by a distance corresponding to L1/V1 or more. That is, in case where the tab portion is detected by the sheet detection sensor, the back end of the tab portion is recognized as a back end of the sheet, so that the timing at which the switch back is commenced is excessively delayed by a time taken to transport the sheet at a distance corresponding to the tab width. This lowers a printing performance (performance in an image formation process).

Further, a problem caused by uncertainty in sheet detection due to unevenness of the tab position occurs not only in case where the tab sheet is switched back. For example, in case of controlling a sheet transport interval, at which a plurality of sheets are sequentially transported, in accordance with a result obtained by detecting the back end of the sheet with the sheet detection sensor, when the tab portion passes through the detection position of the sheet detection sensor, the sheet transport interval is excessively large so as to correspond to the tab width.

In order to prevent the uncertainty in sheet detection due to unevenness of the tab position, a plurality of sheet detection sensors may be provided so as to be orthogonal to the sheet transporting direction for example, thereby always detecting portions other than the tab portion as the back end of the tab sheet. However, in this case, a plurality of sheet detection sensors are provided on respective necessary points in a transport path in a vertical direction with respect to the sheet transporting direction. Such arrangement results in higher cost.

SUMMARY OF THE INVENTION

The present invention was devised from the foregoing view point, and its object is to provide a sheet transporting device, a sheet transporting method, and an image recording device having the sheet transporting device, each of which can appropriately control sheet transport also with respect to plural kinds of tab sheets different from each other in terms of a tab position in a transporting direction without increasing the cost.

The sheet transporting device according to the present invention includes a sheet detection section for detecting that each of transported sheets reaches a specific position, wherein in case of transporting a tab sheet, the tab sheet is transported so that its end having a tab is a back end of the tab sheet in a transporting direction, and sheet transport is controlled in accordance with a timing, at which the sheet detection section detects a front end of the tab sheet, in consideration for a tab width.

Here, the tab sheet is a sheet having an auriform protruding portion (tab) on its end portion. Further, the tab width is a tab's length in a sheet transporting direction. Further, "to control the sheet transport" means to control various conditions in appropriately transporting sheets in the sheet transporting device, and examples thereof include: a speed at which the sheets are transported; an interval at which the sheets are transported; switching of a transport path; and the like.

In this manner, the sheet transport is controlled in accordance with a timing at which the front end of the tab sheet, i.e., an end having no tab is detected, so that it is possible to appropriately control the sheet transport also with respect to plural kinds of tab sheets different from each other in terms of a tab position in a vertical direction with respect to the transporting direction without providing a plurality of sheet detection sections in the vertical direction with respect to the sheet transporting direction. That is, it is possible to provide a sheet transporting device which can appropriately control the sheet transport also with respect to plural kinds of tab sheets different from each other in terms of a tab position in a vertical direction with respect to the transporting direction without increasing the cost.

Further, the sheet transporting device according to the present invention may be arranged so that: in case of transporting a normal sheet, the sheet transport is controlled in accordance with a timing at which the sheet detection section detects a back end of the normal sheet.

Here, the normal sheet is a substantially rectangular sheet which is not the tab sheet. It is general that: in case of transporting the normal sheet, the sheet transport is controlled by detecting a back end of a sheet, so that it is possible to control the sheet transport with higher accuracy than by detecting a front end of a sheet. This is because sheet sliding or a similar trouble may occur while the sheet is being transported from a position in which its front end is detected by the sheet detection section to a position in which its back end is detected by the sheet detection section.

Thus, in case of transporting the normal sheet, the sheet transport is controlled by causing the sheet detection section to detect a back end of the normal sheet, so that it is possible to improve the accuracy in controlling the sheet transport.

Further, the image recording device according to the present invention, provided with a sheet transporting device for transporting sheets, includes: a sheet detection section for detecting that each of transported sheets reaches a specific position; and a control section for controlling sheet transport in accordance with a timing at which the sheet detection section detects the sheet, wherein: in case where the sheet is a tab sheet, the sheet transporting device transports the tab sheet so that its end having a tab is a back end of the tab sheet in a transporting direction, and the control section controls the sheet transport in accordance with a timing, at which the sheet detection section detects a front end of the tab sheet, in consideration for a tab width.

Therefore, it is possible to provide an image recording device which can appropriately control the sheet transport also with respect to plural kinds of tab sheets different from each other in terms of a tab position in a vertical direction with respect to the sheet transporting direction without increasing the cost.

Further, the sheet transporting method according to the present invention, in which sheet transport is controlled in accordance with a timing at which a sheet detection section for detecting that each of transported sheets reaches a specific position detects a front end of a tab sheet, includes the steps of: transporting the tab sheet so that its end having a tab is a back end of the tab sheet in a transporting direction; and controlling the sheet transport in accordance with a timing at which the sheet detection section detects a front end of the tab sheet.

The sheet transport is controlled in accordance with a timing at which the front end of the tab sheet, i.e., an end having no tab is detected, so that it is possible to appropriately control the sheet transport also with respect to plural kinds of tab sheets different from each other in terms of a tab position in a vertical direction with respect to the sheet transporting direction without increasing the cost.

For a fuller understanding of the nature and advantages of the invention, reference should be made to the ensuing detailed description taken in conjunction with the accompanying drawings.

BRIEF DESCRIPTION OF THE DRAWINGS

FIG. 8(*b*) is an explanatory drawing showing an example of the sheet transport interval in case where a normal sheet is transported.

DESCRIPTION OF THE EMBODIMENTS

The following description will explain one embodiment of the present invention with reference to FIG. 1 to FIG. 11, FIG. 13 and FIG. 14.

A sheet transporting mechanism 101 (FIG. 2), according to the present embodiment, which functions as a sheet transporting device is provided on a digital copying machine (image recording device) 1. That is, the digital copying machine 1 is arranged so that: the sheet transporting mechanism 101 transports a sheet to a predetermined position in the digital copying machine 1, and an image is formed on thus transported sheet, and the sheet having the image is discharged. Further, the sheet transporting mechanism 101 can carry out reversal transport by which the sheet is reversed and transported. Further, the sheet transporting mechanism 101 can appropriately transport a tab sheet having an auriform protruding portion (tab) on its end portion.

(Arrangement of Digital Copying Machine 1)

An arrangement of the digital copying machine 1 is described as follows with reference to FIG. 2 and FIG. 3.

Figure 2:
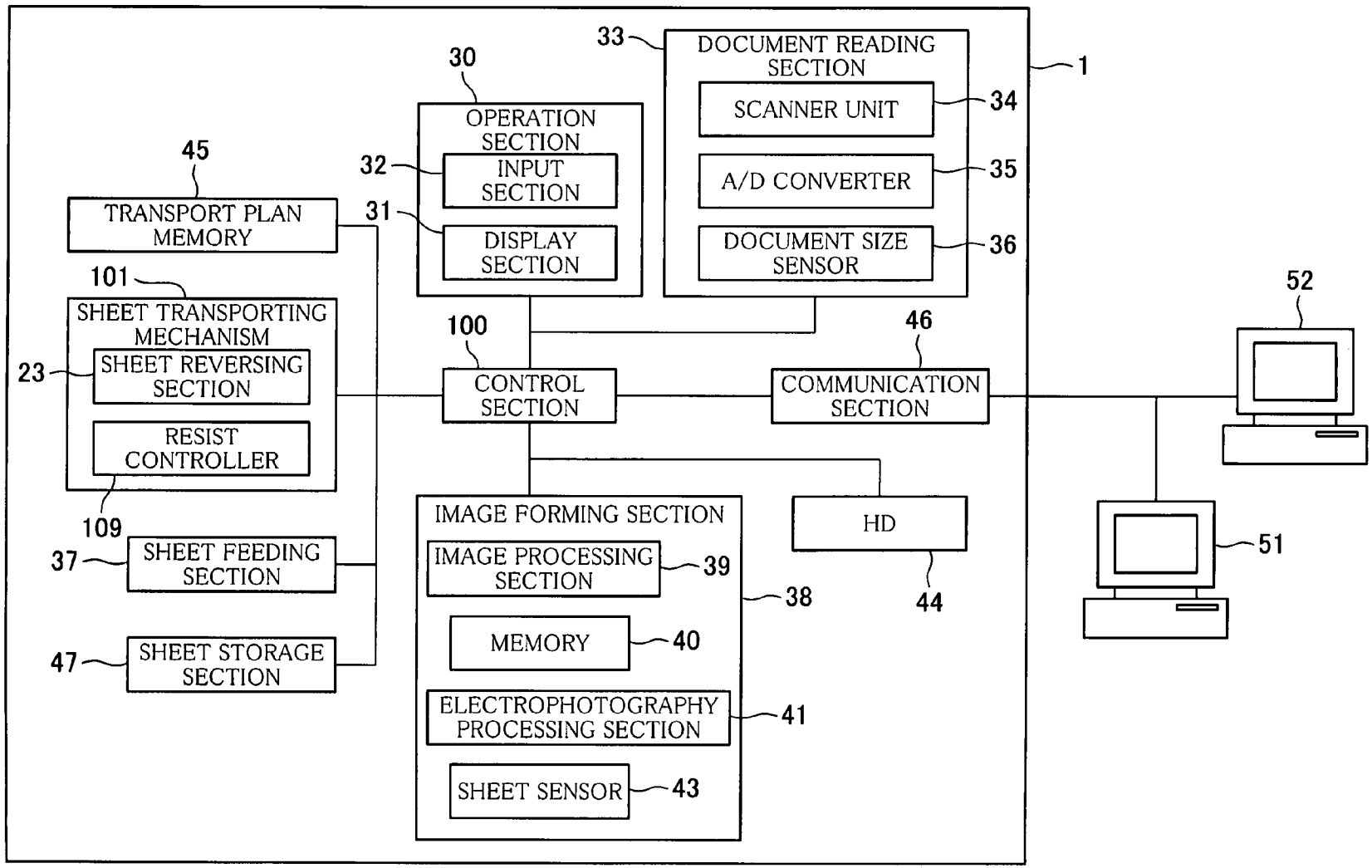
FIG. 2 is an explanatory diagram showing an arrangement of a digital copying machine 1.

FIG. 2 is an explanatory drawing showing the arrangement of the digital copying machine 1. As shown in FIG. 2, the digital copying machine 1 includes an operation section 30, a document reading section 33, a sheet feeding section 37, the sheet transporting mechanism 101, an image forming section 38, a hard disk (HD) 44, a transport plan memory (transport plan storage section) 45, a communication section 46, a sheet storage device 47, and a control section 100.

Note that, the digital copying machine 1 functions as a copying machine for printing an image read with the document reading section 33 and functions also as a printer for printing an image in accordance with print job sent from a terminal device such as a PC (personal computer) by connecting the communication section 46 to the terminal device via a network. Here, the network includes a wiring (cable) for connecting the digital copying machine 1 and the terminal device to each other, and examples of the network include: a wide network such as LAN, Internet, and the like; a serial cable connecting devices to each other; and the like.

The control section 100 functions as a brain of the digital copying machine 1 so as to control the entire operations of the digital copying machine 1. That is, the control section 100 controls components of the digital copying machine 1 in accordance with the print job inputted via the operation section 30 or the communication section 46, and causes all the processes of the digital copying machine 1, such as sheet feeding, sheet transport, image formation, and the like, to be carried out.

The operation section 30 includes a display section 31 and an input section 32. To the user, the display section 31 informs an operation condition of the digital copying machine 1 or informs that the digital copying machine 1 is on standby for instructions of the user (the digital copying machine 1 is waiting for the user to input any instruction).

The input section 32 receives instructions that the user gives to the digital copying machine 1. That is, the input section 32 receives instructions concerning a size and a kind of sheets, the number of copied sheets (the number of sheets on which images are to be printed), a discharging process, and the like, from the user, so as to send the instructions to the control section 100. Note that, the input section 32 receives information concerning whether the sheet is a tab sheet or not, whether the sheet is a normal sheet (substantially rectangular sheet which is not the tab sheet) or not, or whether the tab and normal sheets are mixed or not, from the user, so as to send the information to the control section 100.

The document reading section 33 includes a document placement table (not shown), a scanner unit (document image reading unit) 34 for scanning and reading an image of a document placed on the document placement table, an A/D conversion section 35, and a document size sensor 36.

The scanner unit 34 reads a document transported to the document placement table, so as to obtain image data. The A/D conversion section 35 converts an analog signal of the image data read by the scanner unit 34 into a digital signal. The document size 36 detects a size of the document transported to the document placement table, so as to inform the size to the control section 100.

Figure 3:
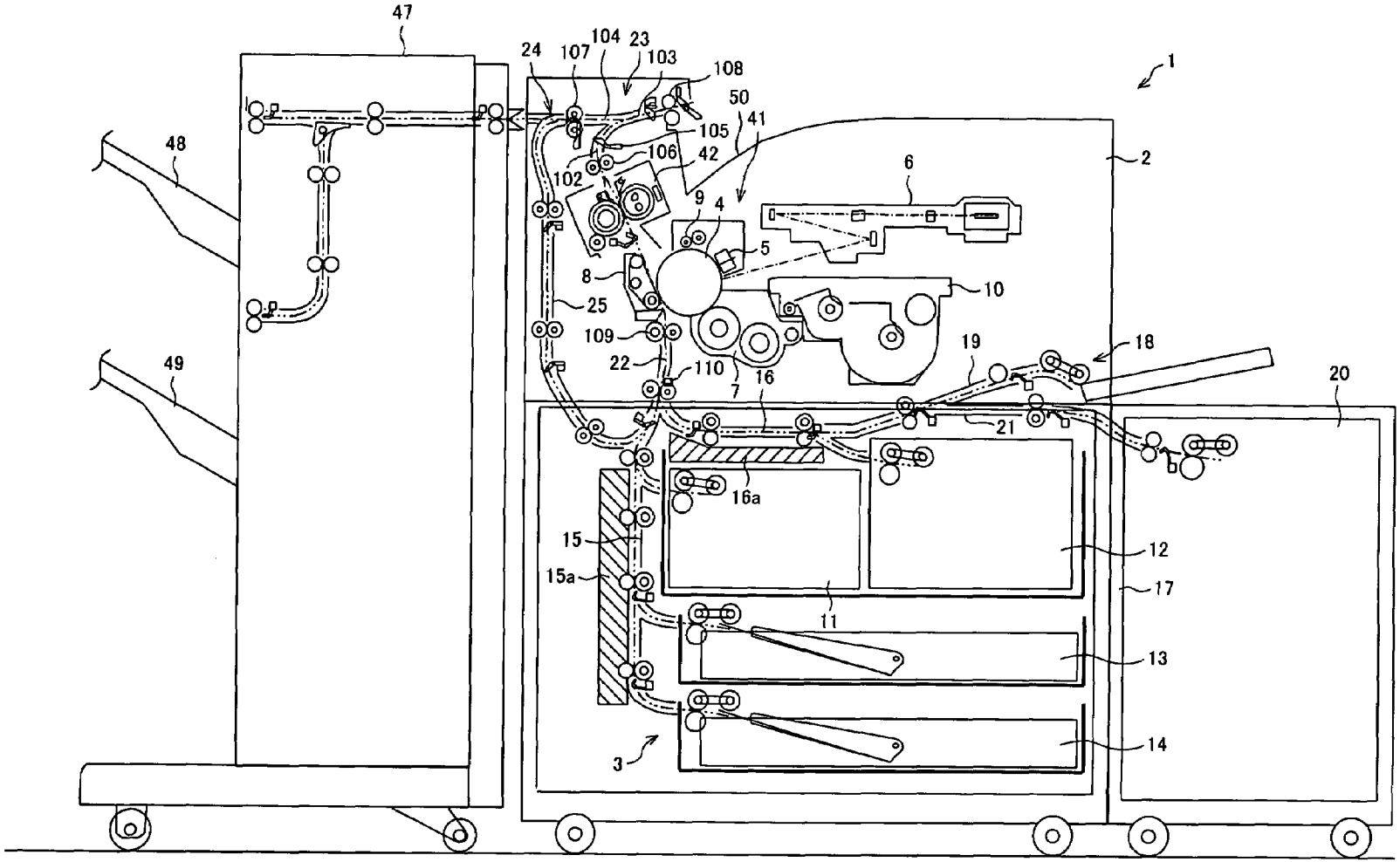
FIG. 3 is a cross sectional view showing the arrangement of the digital copying machine 1.

As shown in FIG. 3, the sheet feeding section 37 includes: a multistage sheet feeding unit 3 in which plural kinds of sheets are stacked; a manual sheet feeding unit (multi manual sheet feeding unit) 18 on which a relatively small amount of sheets are stacked; and a large volume sheet feeding unit 20. In the digital copying machine 1, a sheet is transported from any one of these sheet feeding units, and an image is formed on a surface of the transported sheet.

The sheet transporting mechanism 101 pulls sheets one by one from any one of the sheet feeding units in accordance with an instruction given by the control section 100, and supplies and transports each of the sheets to an appropriate position.

Further, the sheet transporting mechanism 101 includes a sheet reversing section (reversal transport section) 23 for carrying out the reversal transport of the sheet. Further, in the digital copying machine 1, the control section 100 controls a timing, at which the sheet reversing section 23 switches back the sheet, so as to suppress a transport error in case where a tab sheet is reversed and transported.

Further, the sheet transporting mechanism 101 is arranged so that: the control section 100 adjusts a sheet transport interval at a junction of a main transport path 22, a first transport path 15, and a second transport path 16, that are shown in FIG. 3 and are described later, so as to suppress a transport error in case where a tab sheet is reversed and transported. Note that, the sheet transporting mechanism 101, a process of controlling a switch back timing, and a process of controlling the sheet transport interval, will be detailed later.

The image formation section 38 includes an image processing section 39, a memory 40, an electrophotography processing section 41, a sheet sensor (sheet detection section) 43, and the like.

The image processing section 39 performs various kinds of image processing with respect to image data that has been read by the document reading section 33 or image data that has been inputted via the communication section 46. The memory 40 temporarily stores data that has been subjected to the image processing performed by the image processing section 39. The electrophotography processing section 41 forms an image on a sheet in accordance with image data. The sheet sensor 43 detects a position of a sheet transported via the main transport path 22 (FIG. 3) and informs the detected position to the control section 100 so that an image is formed in an appropriate position of the sheet.

The HD 44 stores data that has been subjected to the image processing by the image processing section 39. That is, in the digital copying machine 1, when a volume of the data that has been subjected to the image processing exceeds a storage capacity of the memory 40, the data is stored in the HD 44, and the data can be read out to the memory 40 as required.

The transport plan memory 45 stores a transport plan table for managing information concerning sheet transport, for example, information concerning (i) where the sheet is fed, (ii) where the sheet is discharged, (iii) a size and a kind of the sheet, (iv) how an image is to be processed.

The communication section 46 is a network interface of the digital copying machine 1. That is, the communication section 46 carries out a process of inputting/outputting communication data (print job and the like) sent and received between PCs 51 and 52.

Note that, each of the PCs 51 and 52 includes various kinds of software such as word processor software, CAD software, and the like, and functions as an information processing device which makes and stores data files in accordance with instructions of the user. Further, each of the PCs 51 and 52 generates print data in accordance with the data file, and makes a print job containing the print data, and sends the print job to the digital copying machine 1, so as to cause the digital copying machine 1 to carry out the printing process.

A sheet storage device 47 stores sheets each of which has an image thereon.

FIG. 3 is a cross sectional view of the digital copying machine 1. With reference to FIG. 3, the arrangement of the digital copying machine 1 is further detailed as follows.

A printer section 2 is provided on an upper side of the digital copying machine 1, and the multistage sheet feeding unit 3 is provided on a lower side of the digital copying machine 1. Further, the manual sheet feeding unit 18 and the large volume sheet feeding unit 20 are provided on a side face (right side of FIG. 3) of the multistage sheet feeding unit 3. Further, the sheet storage device 47 is provided on a side face formed on the digital copying machine 1 so as to be positioned opposite to the large volume sheet feeding unit 20.

Further, the electrophotography processing section 41 is disposed in a substantially central position of the printer section 2. The electrophotography processing section 41 includes a photosensitive drum 4. Around the photosensitive drum 4, there are sequentially provided: a charging unit 5 for evenly charging a surface of the photosensitive drum 4; a light scanning unit 6 for scanning a light image so as to write an electrostatic latent image on the evenly charged photosensitive drum 4; a developing unit 7 for developing the electrostatic latent image, written by the light scanning unit 6, with developer; a transcription unit 8 for transcribing an image, recorded and developed on the photosensitive drum 4, onto a sheet; a fixing section 42 for fixing an image transcribed onto the sheet; a cleaning unit 9 for removing developer remaining on the photosensitive drum 4 so that a new image can be recorded on the photosensitive drum 4; and the like. Note that, the developer removed by the cleaning unit 9 is collected and returned to a developer supplying section 10 of the developing unit 7.

Further, the electrophotography processing section 41 is arranged so that: the main transport path 22 of the sheet transporting mechanism 101 is disposed between the photosensitive drum 4 and the transcription unit 8, and images are sequentially printed on the sheets transported by the sheet transporting mechanism 101. Further, the sheet on which the image has been transcribed is transported to the fixing section 42 by the main transport path 22 of the sheet transporting mechanism 101, and the sheet is subjected to a fixing process.

Next, the sheet transporting mechanism 101 is described as follows. The sheet transporting mechanism 101 includes a first transport path (vertical path) 15, a second transport path (horizontal path) 16, a manual sheet feeding unit transport path 19, a large volume sheet feeding unit transport path 21, the main transport path 22, the sheet reversing section 23, a switching section 24, a re-supplying path 25, and the like.

As shown in FIG. 3, a plurality of sheet supplying sections (sheet feeding trays 11, 12, 13, and 14) each of which stores sheets divided in terms of a kind (size) are provided on the lower side of the digital copying machine 1 (below the printer section 2) as the multistage sheet feeding unit 3. Further, the manual sheet feeding unit 18 for storing a relatively small amount of sheets and the large volume sheet feeding unit 20 are provided on the side face of the digital copying machine 1.

The digital copying machine 1 is arranged so that: the control section 100 selects any one of the sheet feeding trays 11, 12, 13, and 14 of the multistage sheet feeding unit 3 or any one of the large volume sheet feeding unit 20 and the manual sheet feeding unit 18, and causes sheets to be pulled out one by one from thus selected sheet feeding unit (to be separately supplied), and causes the sheets to be sequentially supplied to a gap (transcription section) between the photosensitive drum 4 and the transcription unit 8 of the electrophotography processing section 41. Thus, an image recorded and developed on the photosensitive drum 4 is transcribed onto the sheet.

The first transport path 15 pulls sheets one by one from the sheet feeding trays 11, 13, and 14, so as to transport the sheets to the main transport path 22.

The manual sheet feeding unit transport path 19 pulls sheets one by one from the manual sheet feeding unit 18, so as to transport the sheets to the second transport path 16.

The large volume sheet feeding unit transport path 21 pulls sheets one by one from the large volume sheet feeding unit 20, so as to transport the sheets to the second transport path 16.

The second transport path 16 transports sheets pulled out from the sheet feeding tray 12 to the main transport path 22, or transports sheets transported from the manual sheet feeding unit transport path 19 or the large volume sheet feeding unit transport path 21 to the main transport path 22.

The main transport path 22 transports the sheets, that have been transported from the first transport path 15, a second transport path 16, a re-supplying path 25, to (i) the gap (transcription section) between the photosensitive drum 4 and the transcription unit 8 of the electrophotography processing section 41 and (ii) the fixing section 42. Further, the main transport path 22 transports the sheets, that have been subjected to the fixing process by the fixing section 42, to the sheet reversing section 23.

Further, the sheet sensor (sheet detection section) 110 for detecting that a front end of the transported sheet reaches a specific position and a back end of the transported sheet reaches a specific position is provided on the main transport path 22 so as to be positioned in the vicinity of the junction of the first transport path 15 and the second transport path 16. Further, transport rollers (transport interval adjustment sections) 22R, 15R, and 16R (FIG. 13), each of which exerts a transport-direction force to a sheet, are provided respectively in vicinities of the junction of the transport paths 22, 15, and 16. The digital copying machine 1 is arranged so that: in accordance with a detection signal sent from the sheet sensor 110, the control section 100 determines the transport intervals of the sheets on the basis of a method described later, and controls rotations of the transport rollers 22R, 15R, and 16R that are provided on the respective transport paths, thereby appropriately adjusting intervals of the sheets transported to the main transport path 22. Note that, a method for determining the sheet transport interval and a method for adjusting the sheet transport interval will be detailed later.

The sheet reversing section 23 reverses and discharges the transported sheet (switch back), and is provided on the downstream side with respect to the fixing section 42 in a sheet transporting direction. Note that, the sheet reversing section 23 also can discharge the transported sheet to an upper right discharging section 50, which is a sheet discharging section provided on an upper surface of the digital copying machine 1, without switching back the sheet. The sheet reversing section 23 includes: a carry-in path 102 for carrying a sheet in; a switch back transport path 103 which allows a sheet transporting direction to be switched; a carry-out path 104 for carrying the sheet out; a sheet sensor (detection section) 105 for detecting that the sheet passes; driving roller sections 106 and 107, exerting driving forces to the sheet in the transporting direction, each of which is constituted of a pair of rollers; and an inverse driving roller 108 which can exert a driving force to the sheet in a carry-in direction and in a discharging direction. Note that, an operation of the sheet reversing section 23 at the time of the reversal transport will be detailed later.

Further, a switching section 24 is provided on the downstream side with respect to the sheet reversing section 23 in the transporting direction. The control section 100 shown in FIG. 2 controls an operation of the switching section 24, so that either the re-supplying path 25 for re-supplying the sheet to the electrophotography processing section 41 or a path for discharging the sheet to the sheet storage device 47 is selected so as to transport the sheet, reversed by the sheet reversing section 23, to thus selected path. That is, in case of forming an image on a rear surface of a sheet whose front surface has an image thereon, the control section 100 controls the switching section 24 so that the sheet is transported to the re-supplying path 25. Further, in case where the sheet whose image formation has been completed is transported to the switching section 24, the switching section 24 is controlled so that the sheet is discharged to the sheet storage device 47.

The sheet storage device 47 includes discharge trays 48 and 49, and stores (places) the sheet, discharged via the sheet reversing section 23, on either the discharge tray 48 or 49.

Incidentally, the digital copying machine 1 is arranged so that: in case of sequentially forming images on a plurality of sheets, the images are printed in a page order from the first page, that is, so-called face down output is carried out. Further, the digital copying machine 1 is arranged so that: in case of performing single-side printing for example, a sheet discharged to the upper right discharging section 50 is discharged with its printed surface facing down though the switch back is not performed. Thus, also in case of sequentially forming images on a plurality of sheets, it is possible to store the sheets in an appropriate page order without performing the switch back by discharging the sheet, whose image formation has been completed, to the upper right discharging section 50.

However, in case of discharging a sheet which has been subjected to the single-side printing to the discharge trays 48 and 49, when the switch back is not performed, the sheet is discharged with its printed surface facing upward, and discharged sheets are sequentially stacked. Thus, a last page is positioned uppermost, and a printed surface of the last page faces upward, so that the page order is inverted. Therefore, in case of sequentially discharging a plurality of sheets onto the discharge trays 48 and 49, it is necessary to perform the switch back so that a printed surface of a discharged sheet faces downward in order to stack discharged sheets in a desired order. Then, the digital copying machine 1 is arranged so that: the aforementioned sheet reversing section 23 is provided, so that it is possible to stack sheets always in a desired order irrespective of where the sheets are discharged even in case of sequentially forming images on a plurality of sheets.

Note that, as described above, the digital copying machine 1 is arranged so that the face-down output is carried out. However, the arrangement is not limited to this, and it may be so arranged that face-up output is carried out so as to sequentially print images from the last page. In this case, the switch back is carried out before discharging sheets to the upper right discharging section 50, and the sheets are discharged to the discharge tray 48 or 49 without carrying out the switch back.

(Operations of Sheet Reversing Section 23)

Here, operations of the sheet reversing section 23 at the time of reversal transport are described as follows with reference to FIG. 4(*a*) to FIG. 4(*c*). Each of FIG. 4(*a*) to FIG. 4(*c*) illustrates an operation of the sheet reversing section 23 in case of reversing and transporting a sheet.

As described above, a sheet on which an image has been formed by the transcription section is subjected to the fixing process by the fixing section 42, and then is transported to the sheet reversing section 23. The sheet transported to the carry-in path 102 of the sheet reversing section 23 is transported in a transporting direction by the driving roller 106 as shown in FIG. 4(*a*). Further, when a front end of the sheet reaches the sheet sensor 105 provided on the downstream side with respect to the driving roller section 106 in a transporting direction, and when a back end of the sheet reaches the sheet sensor 105, detection signals indicative of these conditions are respectively sent from the sheet sensor 105 to the control section 100 (FIG. 2). Note that, "a" in FIG. 4(*a*) indicates a length (sheet transport distance), required in preventing the transport error at the time of the switch back, which extends from the sheet sensor 105 to a back end position of the sheet at the time of the switch back so as to be position along the sheet transport path (the carry-in path 102 and the switch back transport path 103).

Figure 4:
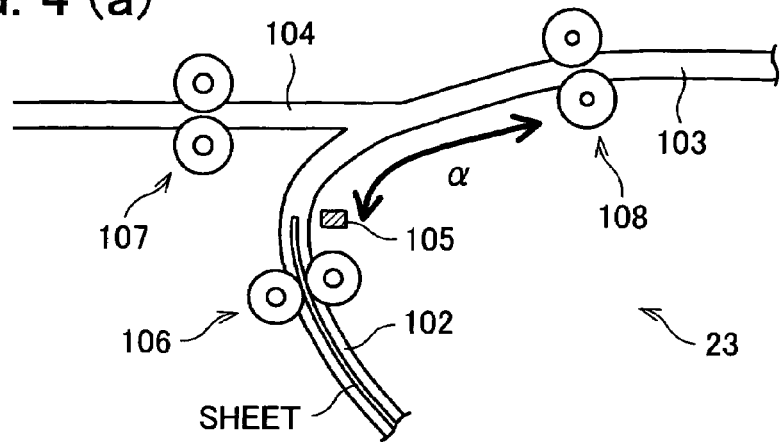
FIG. 4(*a*) to FIG. 4(*c*) are explanatory drawings each of which illustrates a sheet reversal operation of a sheet reversal section 23.
Figure 4:
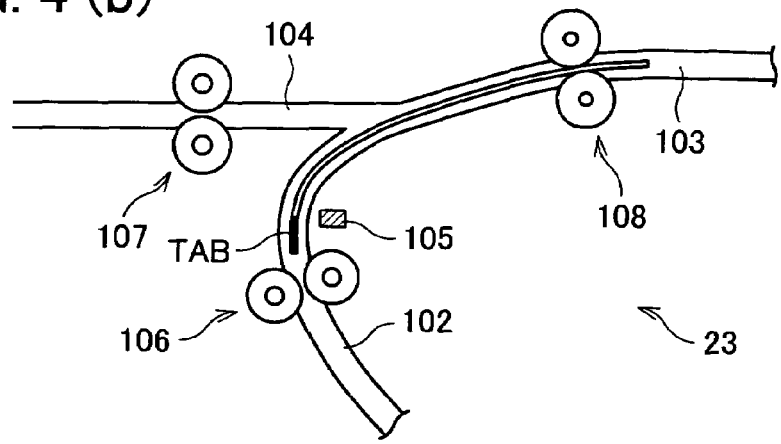
Figure 4:
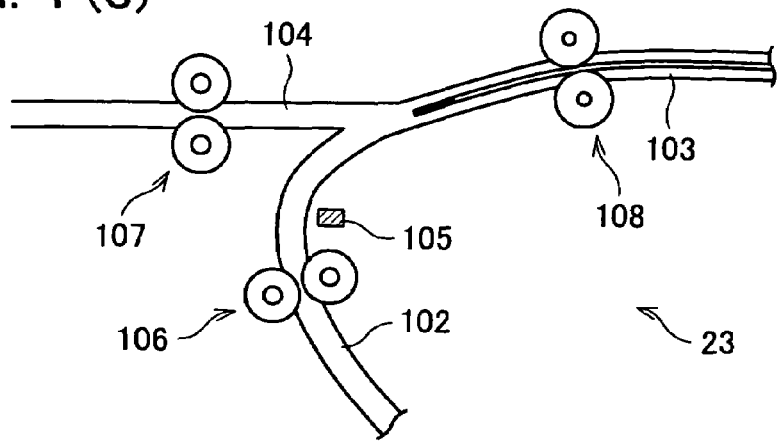

Further, the sheet transported in the transporting direction by the driving roller section 106 is transported to the switch back transport path 103 as shown in FIG. 4(*b*), and is led to a more internal portion of the switch back transport path 103 by the inverse driving roller 108.

Thereafter, as shown in FIG. 4(*c*), a rotation direction of the inverse driving roller 108 is inversed. Thus, the sheet carried in the sheet reversing section 23 is reversed and transported to the transport path 104. Note that, a timing at which the sheet is reversed by switching the rotation direction of the inverse driving roller 108 (a timing of the switching back operation) is controlled by the control section 100 in accordance with the detection signal sent from the sheet sensor 105 to the control section 100.

(Timing Control of The Switch Back)

Next, how the timing for the switch back performed by the sheet reversing section 23 is controlled (sheet transport control) is described as follows.

Figure 1:
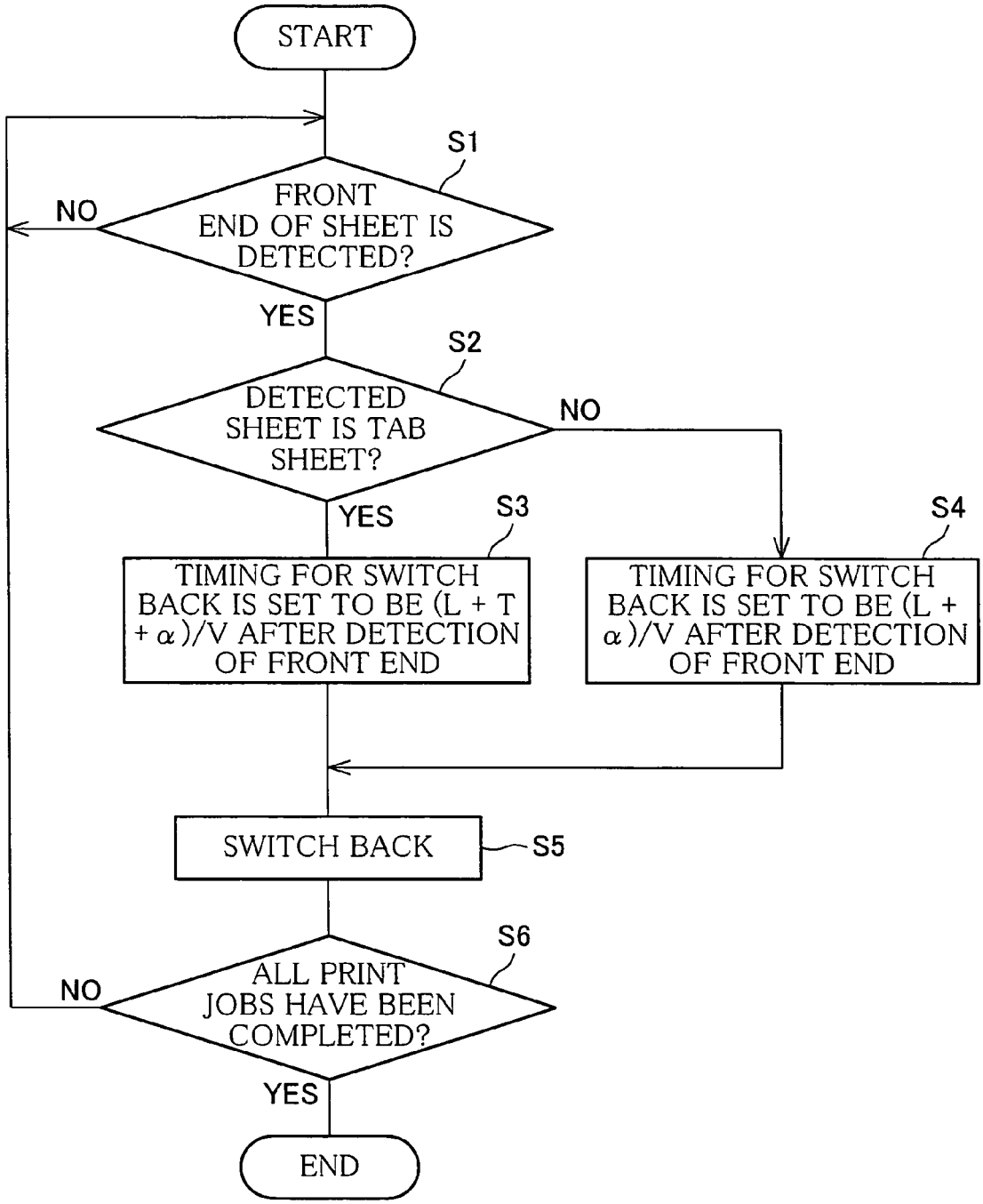
FIG. 1 is a flowchart showing an example of a switch back process in a sheet transporting device of the present invention.

FIG. 1 is a flowchart showing how the switch back process is carried out in the digital copying machine 1. First, the control section 100 is waiting for the sheet sensor 105 to detect a front end of a sheet transported to the sheet reversing section 23 (S1).

Figure 5:
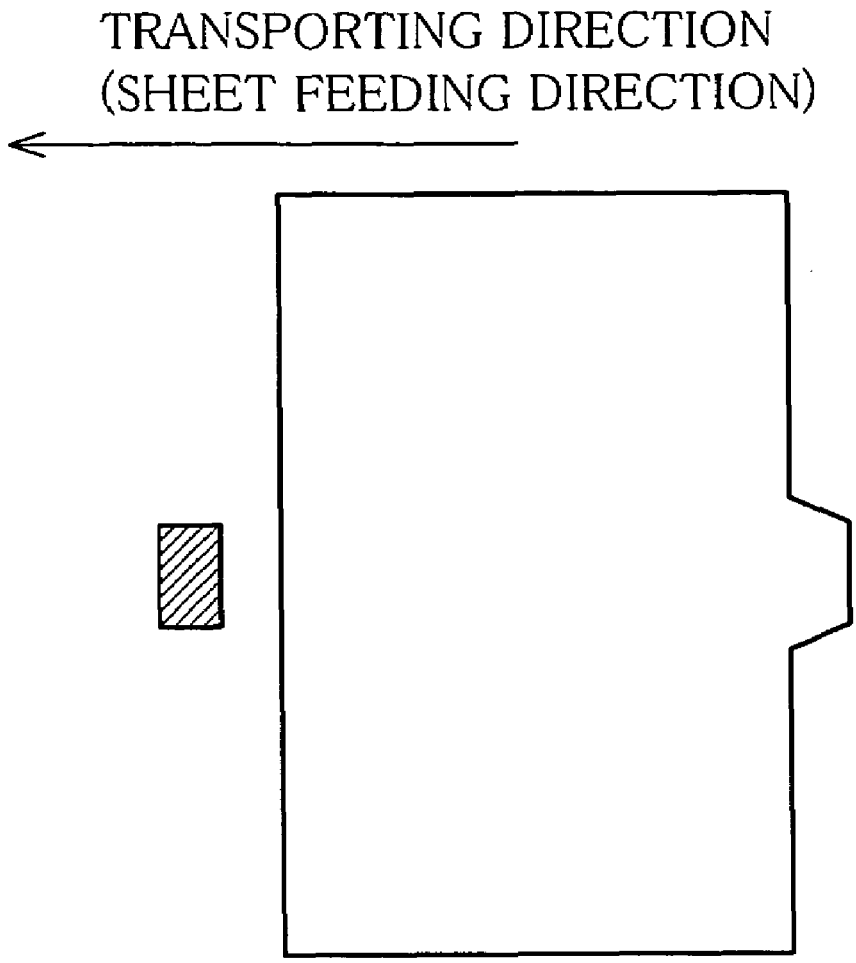
FIG. 5 is an explanatory drawing showing a direction in which a tab sheet is transported in the digital copying machine 1.

Note that, in the digital copying machine 1, in case of transporting a tab sheet, the tab sheet is fed and transported so that an end having a tab is a back end of the sheet in the sheet transporting direction as shown in FIG. 5. That is, the tab sheet is fed and transported so that an end having no tab is a front end of the sheet. This is based on the following reason: in case where the end having the tab is the front end of the sheet, a force required in transporting the sheet is exerted merely to the tab portion in pulling out the sheet from the sheet feeding tray, so that the transport trouble tends to occur and it is difficult to align ends of discharged sheets.

Next, when the front end of the sheet is detected by the sheet sensor 105, the control section 100 determines whether the sheet is a tab sheet or a normal sheet (S2). Note that, whether the sheet is a tab sheet or a normal sheet is determined by referring to the transport plan table stored in the transport plan memory 45 shown in FIG. 2.

Here, the transport plan table is described as follows. In case of forming an image based on the print job in the digital copying machine 1, the control section 100 makes the transport plan table in accordance with an input instruction concerning the print job. Note that, the print job in the digital copying machine 1 is constituted of information inputted via the communication section 46 and information generated by the control section 100 in accordance with information inputted via the input section 32. Table 1 shows an example of the transport plan table.

TABLE 1

| SHEET ID | IMAGE ID | IMAGE PROCESS | WHERE THE SHEET IS DISCHARGED | WHERE THE SHEET IS FED | SHEET SIZE |
|---|---|---|---|---|---|
| 1 | ID 1 | SINGLE-SIDE PRINT | DELIVERY TRAY 48 | MANUAL FEEDING | A4 TAB |
| 2 | ID 2 | SINGLE-SIDE PRINT | DELIVERY TRAY 48 | SHEET FEEDING TRAY 11 | A4 |
| 3 | ID 3 | SINGLE-SIDE PRINT | DELIVERY TRAY 48 | SHEET FEEDING TRAY 11 | A4 |
| 4 | ID 4 | SINGLE-SIDE PRINT | DELIVERY TRAY 48 | MANUAL FEEDING | A4 TAB |
| 5 | ID 5 | SINGLE-SIDE PRINT | DELIVERY TRAY 48 | SHEET FEEDING TRAY 11 | A4 |
| — | — | — | — | — | — |

The transport plan table shown in Table 1 is constituted of a sheet ID, an image ID, image process information, information concerning where the sheet is discharged, information concerning where the sheet is fed, and sheet size information. The sheet ID is an ID number given to each sheet on which an image is formed in accordance with the print job. The image ID is an ID number of data of an image formed on each sheet. With respect to each sheet in which images are printed on its both surfaces, two image IDs are given. The image process information is information which indicates whether the print process performed with respect to each sheet is the single-side print or the double-side print. The information concerning where the sheet is discharged is information which indicates a tray to which each sheet is discharged. The information concerning where the sheet is fed is information which indicates a feeding member from which each sheet is fed. The sheet size information is information which indicates (i) a size of each sheet discharged as the print job and (ii) whether the sheet is a tab sheet or a normal sheet.

As to the print job shown in the transport plan table of Table 1 as an example, five sheet are listed, and a first sheet (sheet whose sheet ID is "1") is an A4-size tab sheet fed from the manual sheet feeding unit 18. Likewise, a second sheet is a normal A-4 size sheet fed from the sheet feeding tray 11.

In case where a sheet transported to the sheet reversing section 23 is determined as being a tab sheet as a result of determination carried out by referring to the transport plan table, the control section 100 sets a timing for the switch back to be a time after transporting the sheet at a distance corresponding to sheet length L+tab width T+$\alpha$ after the sheet sensor 105 has detected a front end of the sheet (tab sheet) (S3). That is, when the transport speed of the sheet is V, a timing at which the rotation direction of the inverse driving roller 108 is inverted is set to be a time after a period corresponding to $(L+T+\alpha)/V$ after the sheet sensor 105 has detected a front end of the sheet (tab sheet).

Note that, the sheet length L is a length of a sheet in a sheet transporting direction (excluding a tab portion), and the tab width T is a length (width) of the tab portion in the sheet transporting direction. Further, the sheet transport distance $\alpha$ is a sheet transport distance between (i) a position in which a back end of a tab portion of a tab sheet or a back end of a normal sheet passes through a detection point of the sheet sensor 105 and (ii) a position in which the switch back is performed (FIG. 4(*a*)).

While, in case where the sheet transported to the sheet reversing section 23 is a normal sheet (other than the tab sheet), the control section 100 sets the timing for the switch back to be later than a time corresponding to $(L+\alpha)/V$ after the sheet sensor 105 has detected a front end of the sheet (S4).

Further, the rotation direction of the inverse driving roller 108 is inverted in accordance with the timing that has been set in S3 or S4 (S5).

Next, the control section 100 determines whether there is an unexecuted print job in the transport plan table or not, that is, whether all the print jobs have been carried out or not (S6). Further, in case where there is an unexecuted print job, the process performed from the step S1 is continued. Further, in case where there is no unexecuted print job in the transport plan table, the switch back is ended.

In this manner, the timing for the switch back is controlled in accordance with the timing at which the sheet sensor 105 detects the front end of the sheet, so that it is possible to appropriately control the timing for the switch back also with respect to plural kinds of tab sheets different from each other in terms of a tab position in the sheet transporting direction. Further, in this case, it is not necessary to provide a plurality of sheet sensors in a vertical direction with respect to the sheet transporting direction, so that the cost is not increased.

Further, in case of reversing and transporting a normal sheet, it is possible to avoid such condition that a timing for commencing the switch back is excessively delayed by a time taken to transport the tab portion, so that it is possible to reduce a time taken to carry out the switch back.

Further, a back end of a normal sheet or a tab of a tab sheet at the time of commencement of the switch back can be kept at the same position, so that an operation in the case of reversing and transporting a tab sheet and a normal sheet is stabilized. As a result, it is possible to suppress the transport trouble.

Note that, according to an example shown in FIG. 1, in the case where the sheet transported to the sheet reversing section 23 is a tab sheet or in the case where the sheet transported to the sheet reversing section 23 is a normal sheet, the switch back is performed in accordance with the timing at which the sheet sensor 105 detects a front end of the sheet in the sheet transporting direction. However, the arrangement is not limited to this.

For example, the following arrangement may be made: when a plurality of transported sheets include one or more tab sheets in case of sequentially transporting the plural sheets, the switch back is performed in accordance with the timing at which the sheet sensor 105 detects a front end of the sheet. When the plurality of sheets includes no tab sheet, the switch back is performed in accordance with a timing at which the sheet sensor 105 detects a back end of the sheet.

In this case, when sequentially transporting the plurality of sheets including any tab sheets, the sheet transport is controlled always in accordance with the timing, at which the sheet sensor 105 detects a front end of the sheet, irrespective of whether the sheet is a tab sheet or a normal sheet. When sequentially transporting the plurality of sheets including no tab sheet, the sheet transport is controlled in accordance with the timing at which the sheet sensor 105 detects the back end of the sheet.

Thus, in the case of transporting the plurality of sheets including any tab sheets, it is possible to appropriately control the sheet transport also with respect to plural kinds of tab sheets different from each other in terms of a tab position in the sheet transporting direction without providing a plurality of sheet detection sections. Further, in the case of transporting the plurality of sheets including no tab sheet, the sheet transport is controlled in accordance with the timing at which the sheet detection section detects the back end of the normal sheet, so that it is possible to improve the accuracy in controlling the sheet transport.

Further, a single timing in accordance with which the timing for the switch back is controlled is determined on the basis of whether a plurality of transported sheets include any tab sheets or not, so that it is possible to control the timing for the switch back with a simple arrangement. Further, as the timing in accordance with which the timing for the switching back is controlled, either the timing at which a front end of the sheet is detected or the timing at which a back end of the sheet is detected is selected, so that the accuracy in controlling the timing for the switch back is uniformed. As a result, it is possible to stabilize the sheet transport operation.

Figure 6:
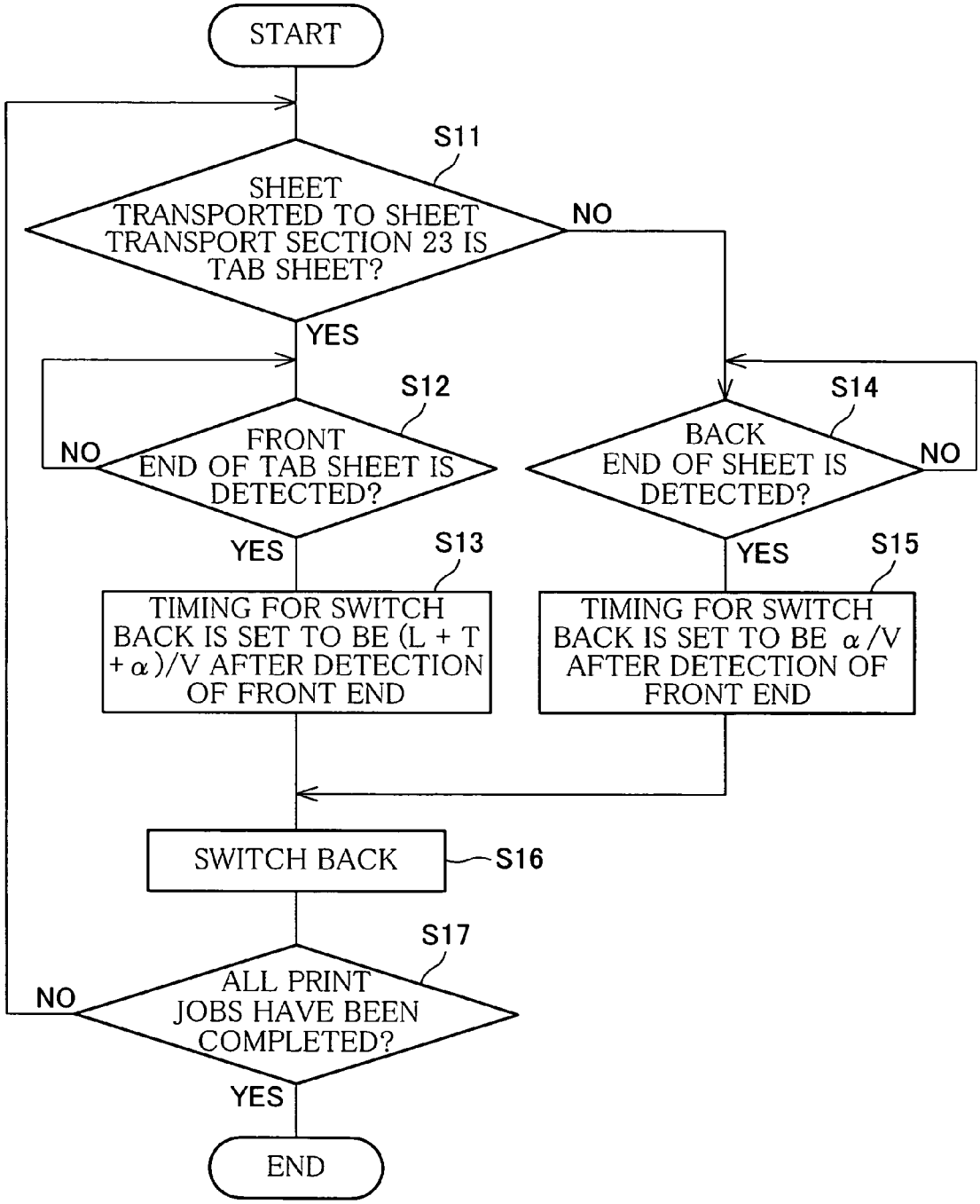
FIG. 6 is a flowchart showing another example of the switch back process in the sheet transporting device of the present invention.

Further, in the case where a sheet transported to the sheet reversing section 23 is a tab sheet, the switch back process is performed in accordance with the timing at which the sheet sensor 105 detects a front end of the tab sheet. While, in the case of a normal sheet, the switch back process may be performed in accordance with the timing at which a back end of the sheet is detected. FIG. 6 is a flowchart showing how the switch back process is carried out in such case.

According to an example shown in FIG. 6, in case of performing the switch back process, first, the control section 100 determines whether a sheet transported to the sheet reversing section 23 is a tab sheet or a normal sheet (S11). Note that, whether the sheet transported to the sheet reversing section 23 is a tab sheet or a normal sheet is determined by referring to the transport plan table stored in the transport plan memory 45.

Further, in the case where the sheet transported to the sheet reversing section 23 is a tab sheet, the control section 100 is waiting for the sheet sensor 105 to detect a front end of the tab sheet in the transporting direction (S12).

Further, when the front end of the tab sheet is detected by the sheet sensor 105, the timing for the switch back is set to be later than a time corresponding to $(L+T+\alpha)/V$ after the front end of the tab sheet has been detected (S13).

While, in the case where the sheet transported to the sheet reversing section 23 is a normal sheet, the control section 100 is waiting for the sheet sensor 105 to detect a back end of the sheet in the transporting direction (S14).

Further, when the back end of the sheet is detected by the sheet sensor 105, the timing for the switch back is set to be later than a time corresponding to a/V after the sheet sensor 105 has detected the back end of the sheet (S15).

Further, the rotation direction of the inverse driving roller 108 is inversed in accordance with the timing that has been set in S13 or S15 (S16).

Next, the control section 100 determines whether there is an unexecuted print job in the transport plan table or not, that is, whether all the print jobs have been carried out or not (S17). Further, in case where there is an unexecuted print job, the process performed from the step S11 is continued. Further, in case where there is no unexecuted print job in the transport plan table, the switch back process is ended.

In this manner, the timing for the switch back is determined in accordance with a time elapsed after the sheet sensor 105 has detected the back end of the normal sheet, so that it is possible to reduce the transport troubles such as simultaneous transport of plural sheets, sheet sliding, and the like, compared with a case where the timing for the switch back is determined in accordance with a time elapsed after the front end of the normal sheet has been detected. This is because the sheet sliding or a similar trouble may occur while the sheet is being transported from a position in which its front end is detected by the sheet sensor 105 to a position in which its back end is detected by the sheet sensor 105.

Note that, according to examples shown in FIG. 1 and FIG. 6, a timing at which the switch back is performed after the back end of the tab portion of the tab sheet or the back end of the normal sheet has passes through a detection point of the sheet sensor 105 is a constant value ($\alpha/V$). However, the arrangement is not limited to this.

For example, it may be so arranged that: in case of setting the timing for the switch back in accordance with a time elapsed after the sheet sensor 105 has detected the front end of the sheet, a timing at which the switch back is performed after the back end of the tab portion of the tab sheet or the back end of the normal sheet has passes through a detection point of the sheet sensor 105 is delayed from $\alpha 1/V$ later than $\alpha 1/V$ (here, $\alpha \leqq \alpha 1$).

In this manner, in case of setting the timing for the switch back in accordance with a time elapsed after the sheet sensor 105 has detected the front end of the sheet, the timing for the switch back is made later than in the case where the timing for the switch back is set in accordance with a time elapsed after the sheet sensor 105 has detected the back end of the sheet, so that it is easier to obtain a transport distance required in preventing any sheet transport trouble. As a result, it is possible to suppress sheet transport troubles such as simultaneous transport of plural sheets and sheet jam.

That is, in case of controlling the timing for the switch back in accordance with a timing at which the front end of the sheet is detected, the transport distance is set to be long. Thus, even though sheet sliding or similar trouble occurs while the sheet is being transported from a position in which the front end of the sheet is detected by the sheet sensor 105 to a position in which the back end of the sheet is detected by the sheet sensor 105 (during a time of further transport of the sheet by the sheet length L after the detection of the front end of the sheet), it is easier to obtain the transport distance a required in reversing and transporting the sheet.

Further, in the present embodiment, a is a length, extending from the sheet sensor 105 to the inverse driving roller 108, which is positioned along the sheet transport path, but the arrangement is not limited to this. The transport distance a has any length as long as it is long enough to carry out the reversal transport of the sheet.

(Control of Sheet Transport Interval)

Next, the following description explains how the sheet transport interval is controlled in the digital copying machine 1 (sheet transport control). The digital copying machine 1 is arranged so that: in case of sequentially transporting a plurality of sheets including any tab sheets and any normal sheets, (i) a sheet transport interval at which a tab sheet and a next sheet are transported and (ii) a sheet transport interval at which a normal sheet and a next sheet are transported are appropriately set in order to suppress any transport error. Note that, the control section 100 adjusts the sheet transport intervals by controlling a timing, at which the sheet is transported in the junction of the main transport path 22, the first transport path 15, and the second transport path 16, in accordance with a detection signal of the sheet sensor 110 provided on the main transport path 22.

Figure 7:
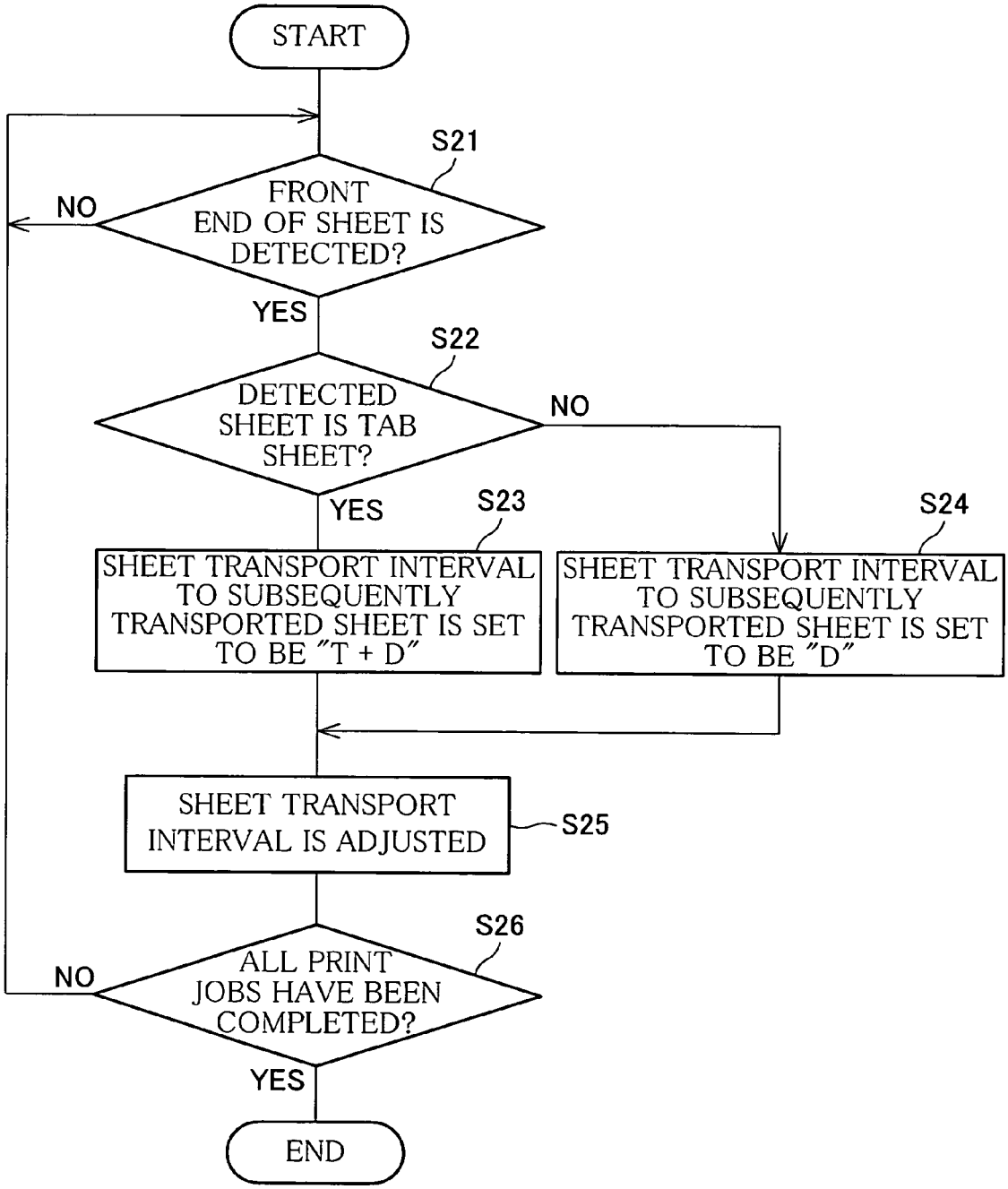
FIG. 7 is a flowchart showing an example of how a sheet transport interval is controlled in the sheet transporting device of the present invention.

FIG. 7 is a flowchart showing how the sheet transport interval is controlled in the digital copying machine 1. In the process of controlling the sheet transport interval shown in FIG. 7, first, the control section 100 is waiting for the sheet sensor 110 provided on the main transport path 22 to detect the front end of the sheet (S21).

When the sheet sensor 110 detects the front end of the sheet, the control section 100 determines whether the sheet detected by the sheet sensor 110 is a tab sheet or a normal sheet (S22). Note that, this determination is carried out by referring to the transport plan table stored in the transport plan memory 45.

Figure 8:
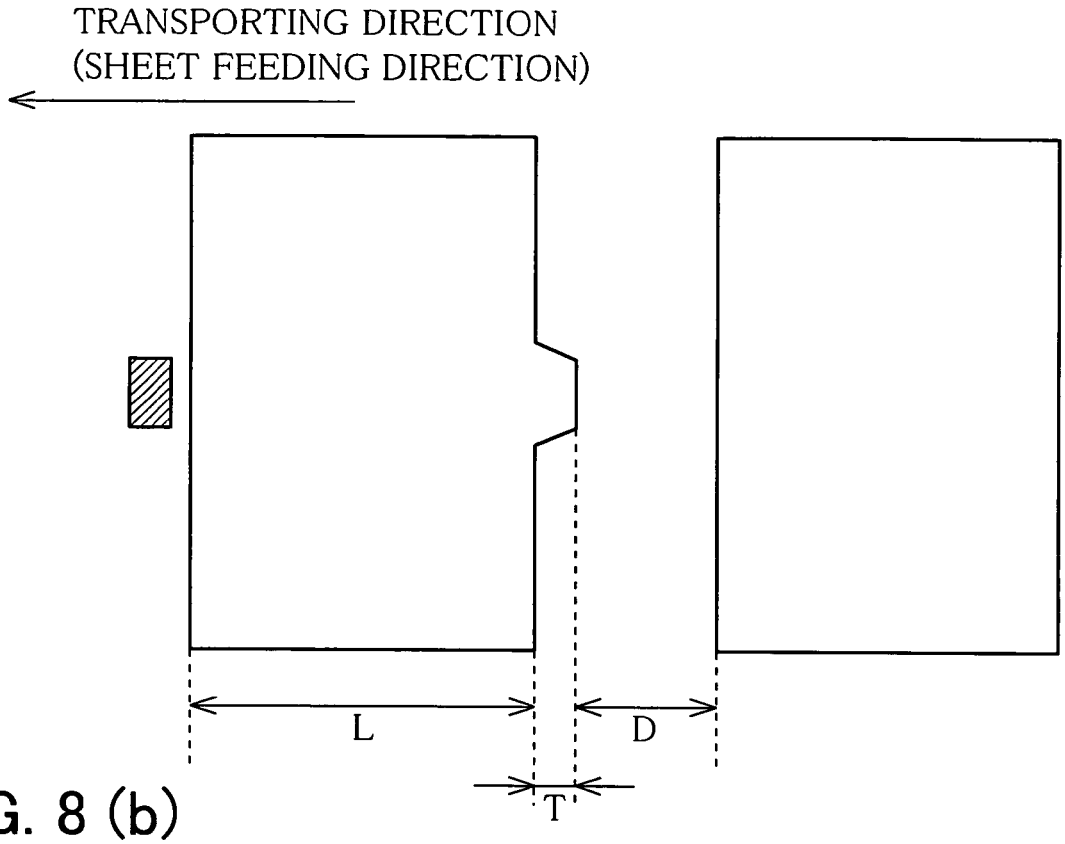
FIG. 8(*a*) is an explanatory drawing showing an example of the sheet transport interval in case where the tab sheet is transported.
Figure 8:
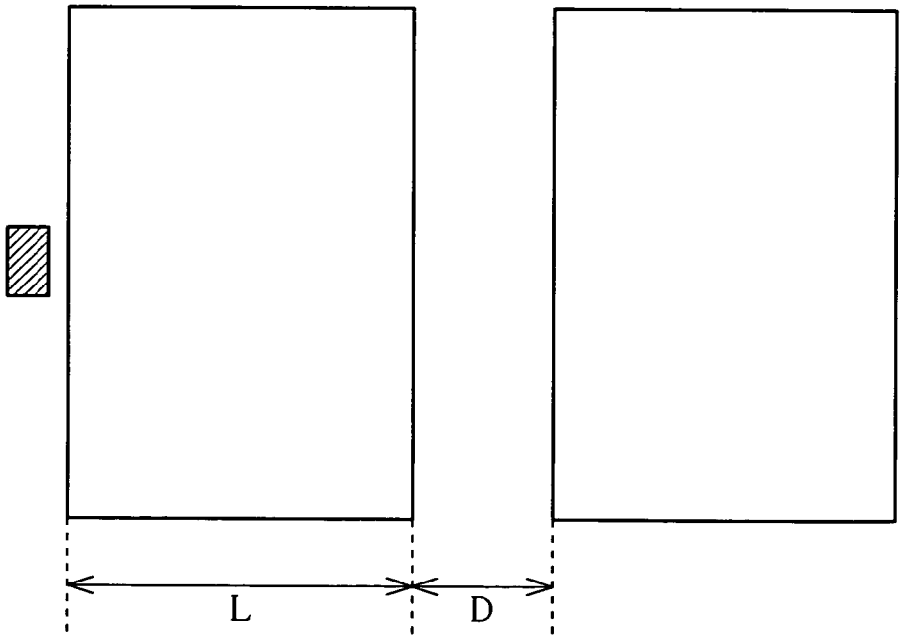

Further, in case where the sheet is a tab sheet, the control section 100 sets the sheet transport interval so that an interval between the front end of the sheet and a front end of a subsequently transported sheet is L+T+D as shown in FIG. 8(*a*) (S23). That is, the sheet transport interval in this case (interval between the front end of the sheet and the front end of the subsequently transported sheet) is T+D. Here, L is a length with respect to a sheet transporting direction, and T is a length (tab width) with respect to a direction in which the tab sheet is transported, and D is an interval required in preventing the transport error when transporting the sheet, particularly when reversing and transporting the sheet in the sheet reversing section 23.

While, in case where the sheet is a normal sheet, as shown in FIG. 8(*b*), the sheet transport interval to the next sheet is set so that an interval between a front end of the normal sheet and a front end of a subsequently transported sheet is L+D (S24). That is, the sheet transport interval in this case is D.

Next, the control section 100 adjusts a timing at which the sheet is transported to the main transport path 22 so as to realize the sheet transport interval that has been set in S23 or S24 (S25). Note that, at this time, when the sheet is a first sheet that has been transported, or when there is a sufficient interval between a previously transported sheet and the sheet, it is not necessary to adjust the timing at which the sheet is transported, and transported sheets are sequentially transported to the main transport path 22.

Figure 13:
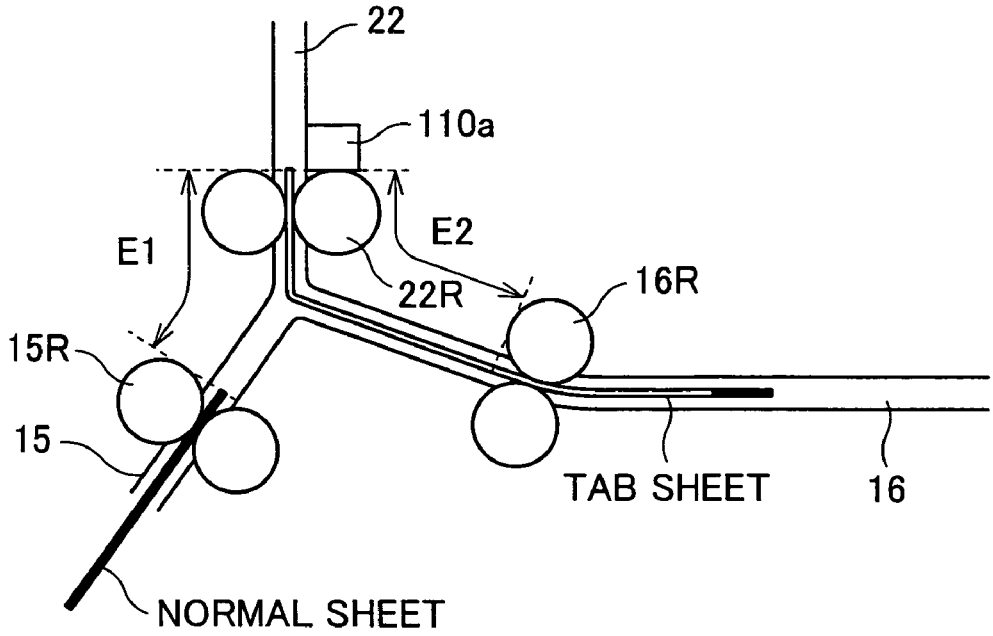
FIG. 13 is an explanatory drawing for illustrating an example of how the sheet transport interval is adjusted in the sheet transport device of the present invention.

Here, how the sheet transport interval is adjusted is described as follows. FIG. 13 is an explanatory drawing for illustrating how the sheet transport interval is adjusted. This drawing schematically shows a vicinity of a junction of the main transport path 22, the first transport path 15, and the second transport path 16, that are shown in FIG. 3. Note that, FIG. 13 shows a case where: a tab sheet transported from the second transport path 16 is transported to the main transport path 22, and a normal sheet transported from the first transport path 15 is transported to the main transport path 22.

First, the tab sheet transported from the second transport path 16 is transported to the main transport path 22. At this time, the normal sheet transported from the first transport path 15 is on standby in front of the junction of the first transport path 15 and the main transport path 22. That is, the control section 100 stops rotation of a transport roller 15R provided on the first transport path 15, and causes the normal sheet to be on standby in front of the junction of the first transport path 15 and the main transport path 22.

Further, when the sheet sensor 110 detects a front end of the tab sheet, the detection signal is transmitted to the control section 100. The control section 100 causes the sheet, which is on standby in front of the junction, to be transported to the main transport path 22 so that: after the sheet sensor 110 detects a front end of the tab sheet, the tab sheet is transported at a distance corresponding to L+T+D, and then a front end of the normal sheet reaches a detection point of the sheet sensor 110.

Note that, in case of transporting the normal sheet and subsequently transporting another sheet for example, a subsequently transported sheet is transported to the main transport path 22 so that: the normal sheet is transported at a distance corresponding to L+D after a front end of the normal sheet is detected by the sheet sensor 110, and then a front end of a subsequently transported sheet reaches a detection point of the sheet sensor 110.

Next, the control section 100 determines whether there is an unexecuted print job in the transport plan table or not, that is, whether all the sheets specified in the print job have been transported or not (S26). Further, in case where there is any sheet that has not been transported, the process performed from the step S21 is continued. Further, in case where there is no sheet that has not been transported, the process of controlling the sheet transport interval is ended.

Figure 9:
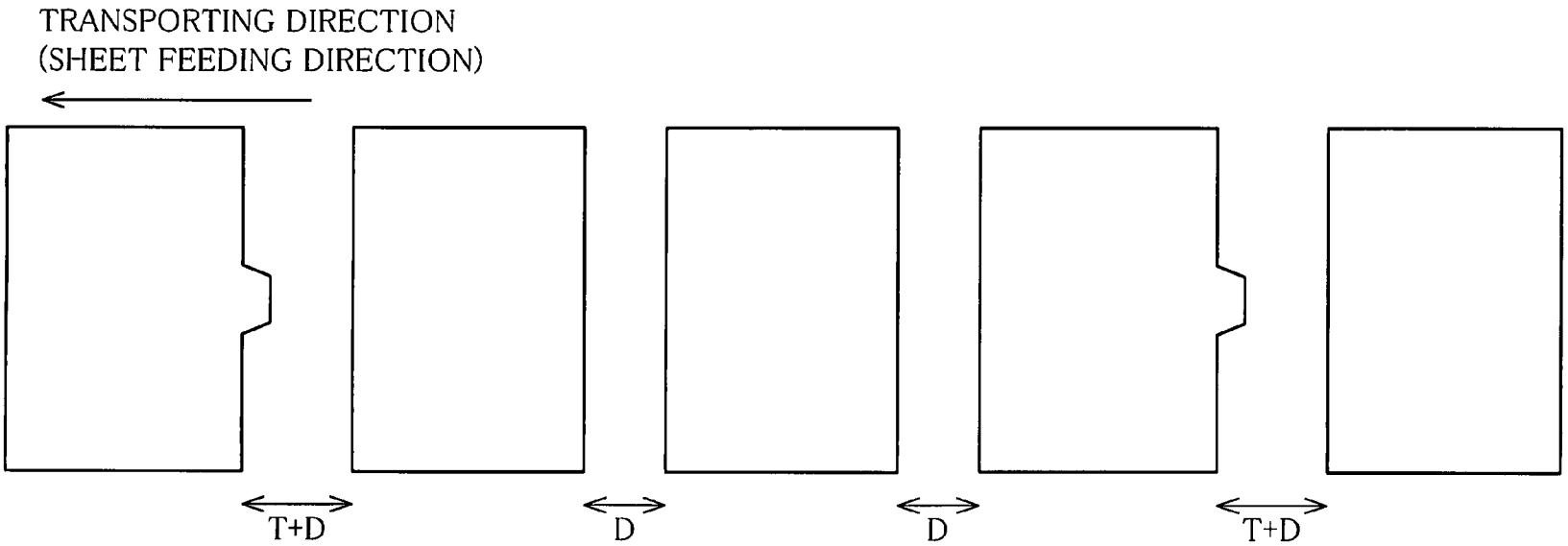
FIG. 9 is an explanatory drawing showing an example of sheet transport intervals in case where sheets are transported in accordance with a sheet transport table shown in Table 1.

FIG. 9 shows intervals of sheets in case of transporting the sheets in accordance with the transport plan table shown in Table 1. In this manner, an interval between the tab sheet and the subsequently transported sheet is T+D, and an interval between the normal sheet and the subsequently transported sheet is D, so that it is possible to obtain a sheet interval required in preventing any trouble which occurs particularly in the switch back performed by the sheet reversing section 23 when transporting sheets.

Note that, according to an example shown in FIG. 7, the sheet transport interval is controlled in accordance with a timing, at which a front end of the sheet is detected by the sheet sensor 110, irrespective of a kind of the sheet (irrespective of whether the sheet is a tab sheet or a normal sheet), but the arrangement is not limited to this.

For example, in case where a plurality of sheets are sequentially transported, when the transported sheets include any tab sheets, the sheet transport interval is controlled in accordance with a timing at which the sheet sensor 105 detects a front end of the sheet, and when the transported sheets include no tab sheet, the sheet transport interval is controlled in accordance with a timing at which the sheet sensor 105 detects a back end of the sheet.

In this case, the sheet transport is controlled in accordance with a timing at which a front end of each sheet is detected irrespective of whether the sheet is a tab sheet or a normal sheet in case of sequentially transporting a plurality of sheets including any tab sheets, and the sheet transport is controlled in accordance with a timing at which a back end of each sheet is detected in case of sequentially transporting a plurality of sheets including no tab sheet.

Thus, in case of transporting a plurality of sheets including any tab sheets, it is possible to appropriately control the sheet transport intervals also with respect to plural kinds of tab sheets different from each other in terms of a tab position in a vertical direction with respect to the transporting direction without providing a plurality of sheet detection sections. Further, in case of transporting a plurality of sheets including no tab sheet, the sheet transport interval is controlled in accordance with a timing at which the sheet detection section detects a back end of a normal sheet, so that it is possible to improve the accuracy in controlling the sheet transport interval.

Further, a single timing in accordance with which the sheet transport interval is controlled is determined on the basis of whether the transported plural sheets include any tab sheets or not, so that it is possible to control the sheet transport interval with a simple arrangement. Further, as a timing in accordance with which the sheet transport interval is controlled, either a timing at which a front end of a sheet is detected or a timing at which a back end of a sheet is detected is selected, so that the accuracy in controlling the sheet transport interval is uniformed. As a result, it is possible to stabilize the sheet transport operation.

Note that, in order to appropriately adjust the sheet transport interval in accordance with the timing at which the back end of the sheet is detected, it is necessary that: a distance, extending from a front end of a standby sheet to the detection point of the sheet sensor 110, which is positioned along the transport path, is made shorter than the sheet transport interval D, in the junction of the transport paths 22, 15, and 16, that are shown in FIG. 13. That is, the digital copying machine 1 is arranged so that: in case where a sheet is on standby in the first transport path 15, a distance E1, extending from a front end of the sheet to the detection point of the sheet sensor 110, which is positioned along the transport path is set so that E1<D. Further, in case where a sheet is on standby in the second transport path 16, a distance E2, extending from a front end of a sheet to the detection point of the sheet sensor 110, which is positioned along the transport path is set so that E2<D.

Figure 10:
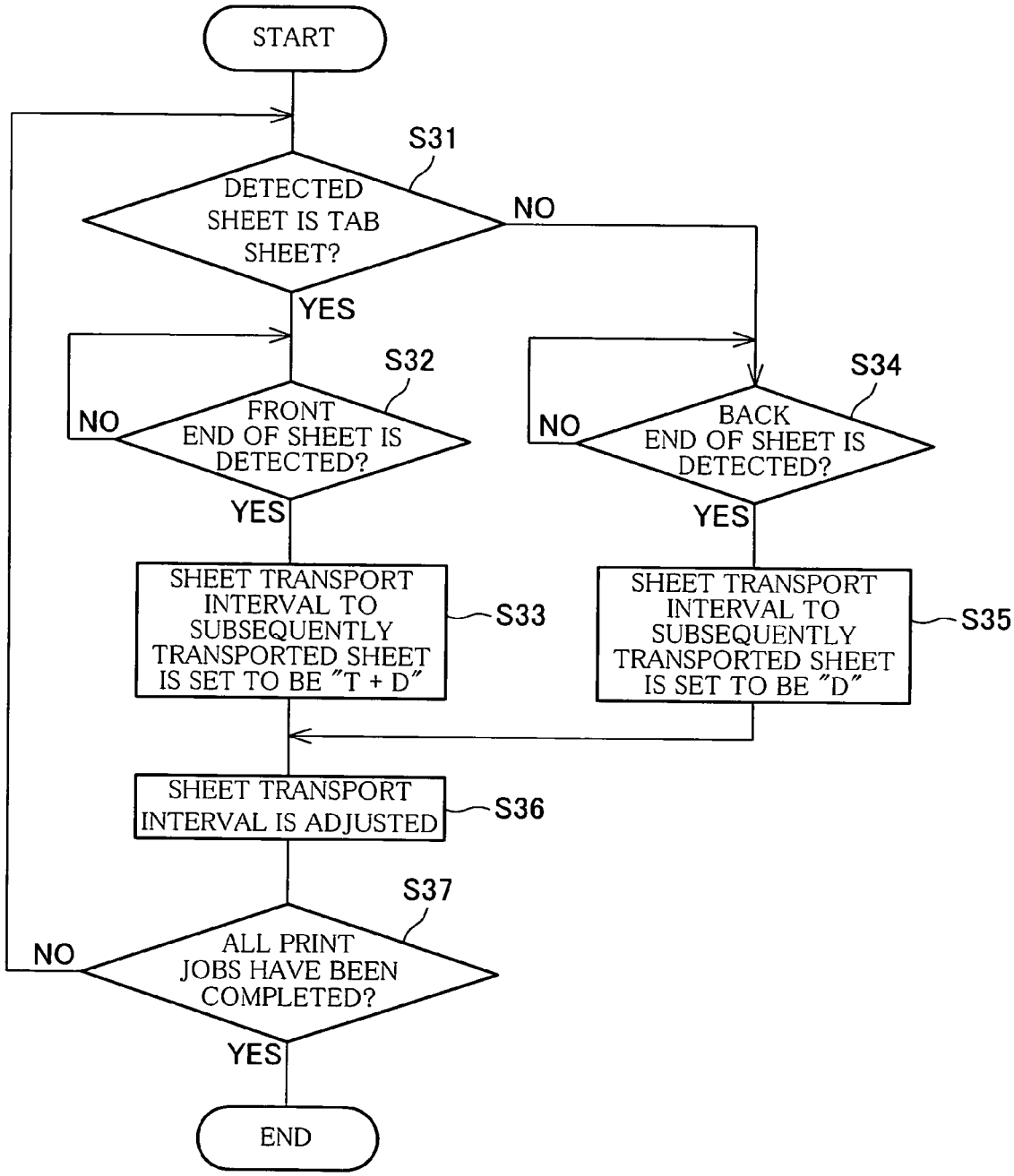
FIG. 10 is a flowchart showing another example of how the sheet transport interval is controlled in the sheet transporting device of the present invention.

Further, it may be so arranged that: a front end of a sheet (tab sheet) is detected in case of detecting a tab sheet, and a back end of a sheet is detected in case of detecting a normal sheet. FIG. 10 is a flowchart showing the process of controlling the sheet transport interval in this case.

In FIG. 10 showing the process of controlling the sheet transport interval, first, the control section 100 determines whether a sheet subsequently detected by the sheet sensor 110 is a tab sheet or a normal sheet (S31). Note that, this determination is performed by referring to the transport plan table stored in the transport plan memory 45.

Further, in case where a sheet subsequently detected by the sheet sensor 110 is a tab sheet, the control section 100 is waiting for a front end of the tab sheet to be detected (S32).

Further, when the front end of the tab sheet is detected, the control section 100 sets the sheet transport interval so that an interval between a front end of the tab sheet and a sheet transported after the tab sheet is L+T+D (S33). That is, in this case, the sheet transport interval between the tab sheet and a sheet transported after the tab sheet is T+D.

While, in case where the sheet subsequently detected by the sheet sensor 110 is determined as a normal sheet in S31, the control section 100 is waiting for a back end of the normal sheet to be detected (S34).

Further, when the back end of the normal sheet is detected, the control section 100 sets the sheet transport interval so that an interval between the back end of the normal sheet and a front end of a sheet transported after the normal sheet is L+D (S35). That is, in this case, the sheet transport interval between the normal sheet and the sheet transported after the normal sheet is D.

Next, the control section 100 adjusts a timing, at which the sheet is transported, in accordance with the aforementioned method, so as to realize the sheet transport interval that has been set in S33 or S35 (S36). Note that, at this time, in case where there is a sufficient interval to the previously transported sheet, it is not necessary to adjust a timing at which the sheet is transported in the junction of the main transport path 22, the first transport path 15, and the second transport path 16, and sheets transported to the junction are sequentially transported.

Next, the control section 100 determines whether there is an unexecuted print job in the transport plan table or not, that is, whether all the sheets specified in the print job have been transported or not (S37). Further, in case where there are any sheets that have not been transported, the process performed from S31 is continued. Further, in case where there is no sheet that has not been transported, the process of controlling the sheet transport interval is ended.

In this manner, in case where the normal sheet is transported, the back end of the sheet is detected by the sheet sensor 110, and the sheet transport interval between the normal sheet and the sheet transported after the normal sheet is determined in accordance with the back end position of thus detected sheet, so that it is possible to improve the accuracy in controlling the sheet transport interval. Here, a reason for which the control accuracy is improved by controlling the sheet transport interval by detecting the back end of the sheet is as follows: the sheet sliding or a similar trouble may occur while the sheet is being transported from a position in which its front end is detected by the sheet sensor 110 to a position in which its back end is detected by the sheet sensor 110.

Note that, according to examples shown in FIG. 7 and FIG. 10, in case where a sheet detected by the sheet sensor 110 is a tab sheet, the sheet transport interval between the tab sheet and a sheet transported after the tab sheet is set to be T+D, and in case where a sheet detected by the sheet sensor 110 is a normal sheet, the sheet transport interval between the normal sheet and a sheet transported after the normal sheet is set to be D. However, the sheet transport interval is not limited to these examples.

As described above, in case of controlling the sheet transport interval in accordance with a timing at which a front end of the sheet is detected, the sheet sliding or a similar trouble may occur while the sheet is being transported from a position in which its front end is detected to a position in which its back end is detected. Thus, the accuracy may drop compared with the case where the sheet transport interval is controlled in accordance with a timing at which the back end of the sheet is detected.

Then, in order to facilitate adjustment of the sheet transport interval so as to prevent the sheet transport trouble even in case of controlling the sheet transport interval in accordance with a timing at which the front end of the tab sheet is detected for example, the sheet transport interval between the tab sheet and the sheet transported after the tab sheet may be made wider than the sheet transport interval between the normal sheet and the sheet transported after the normal sheet.

Figure 11:
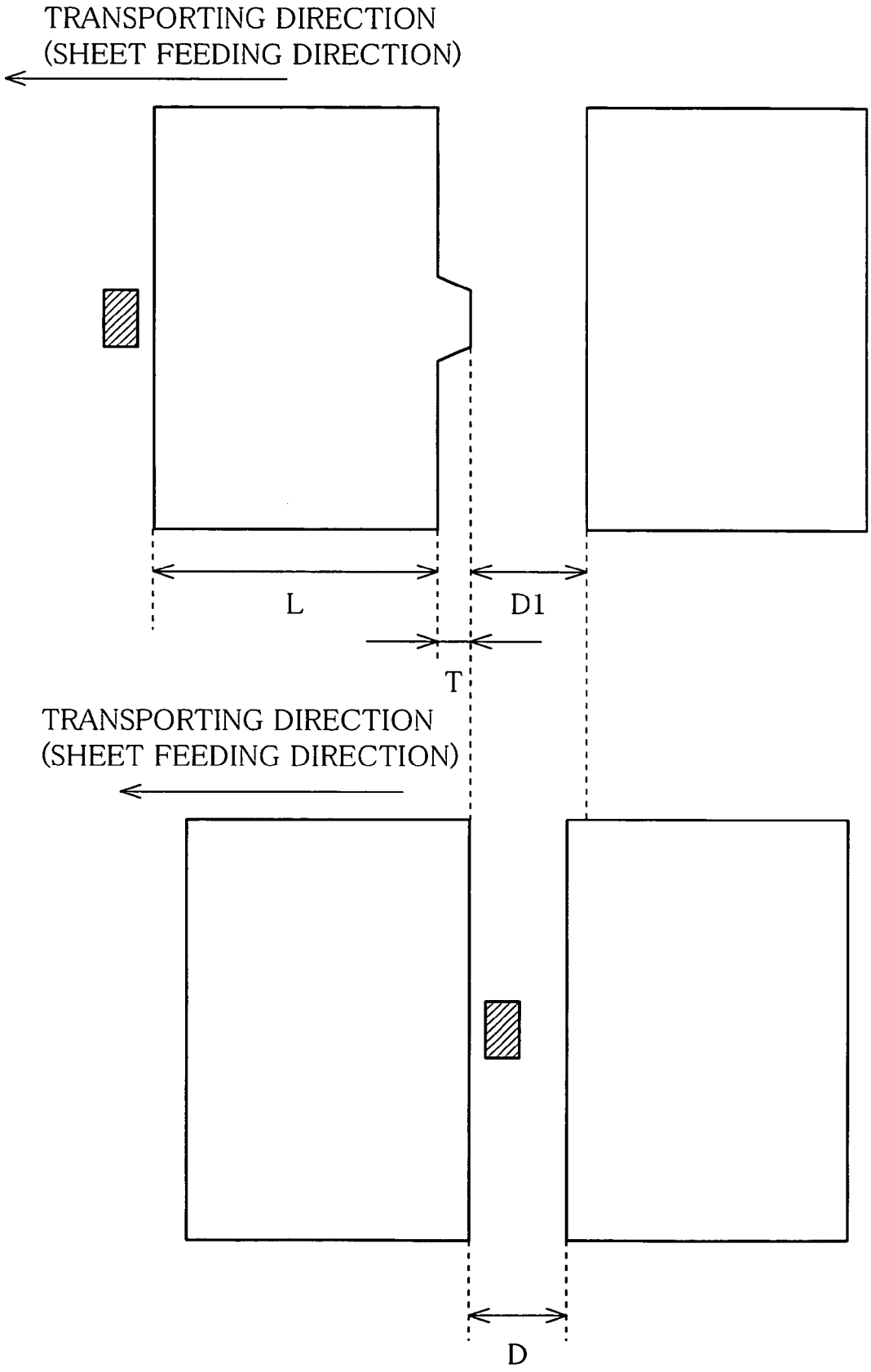
FIG. 11 is an explanatory drawing showing another example of the sheet transport interval in case where the normal sheet is transported.
Figure 12:
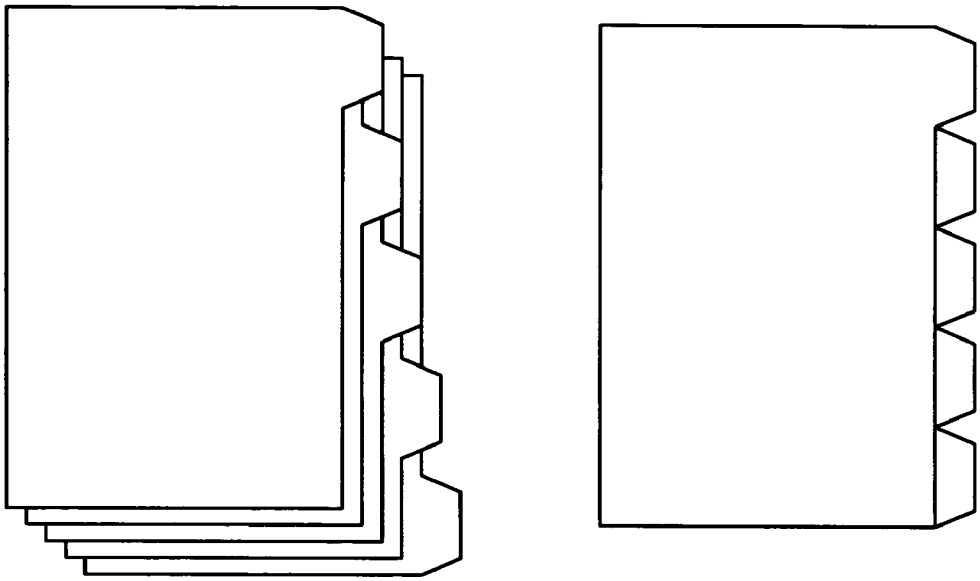
FIG. 12 is an explanatory drawing for illustrating shapes of tab sheets.

That is, as shown in FIG. 11, it may be so arranged that: unlike the sheet transport interval D between the normal sheet and the sheet transported after the normal sheet, the sheet transport interval between the tab sheet and the sheet transported after the tab sheet is set so that T+D1 which is wider than T+D (D≦D1). Thus, it is easier to obtain the sheet transport interval required in preventing the sheet transport trouble, so that it is possible to suppress the sheet transport trouble such as simultaneous transport of plural sheets and sheet jam.

As described above, in case of transporting a tab sheet, the sheet transporting mechanism 101 transports the tab sheet so that its end having a tab is a back end in the transporting direction, and controls the timing for the switch back and the sheet transport interval in accordance with a timing at which the sheet sensor 105 or 110 detects a front end of the tab sheet.

In this manner, the sheet transport interval is controlled in accordance with a timing at which a front end of the tab sheet, i.e., an end having no tab is detected, so that it is possible to appropriately control the sheet transport also with respect to plural kinds of tab sheets different from each other in terms of a tab position in the transporting direction without providing a plurality of sheet detection sections.

Note that, in the present embodiment, the timing for the switch back or the sheet transport interval is controlled in accordance with a timing at which the sheet sensor 105 or 110 detects a front end of the sheet, but the control target is not limited to them. Various kinds of control (sheet transport control) performed to appropriately transport sheets can be based on a timing at which the sheet sensor 105 or 110 detects a front end of the sheet. For example, it may be so arranged that: control such as a transport speed or switching of a transport path is carried out in accordance with a timing at which the sheet sensor 105 or 110 detects a front end of a sheet. Also in case of carrying out such control, the control is carried out in accordance with the timing at which the sheet sensor 105 or 110 detects a front end of a sheet, so that it is possible to obtain a substantially same effect as the process of carrying out the switch back and the process of controlling the sheet transport interval.

Further, in the present embodiment, the timing for the switch back or the sheet transport interval is controlled in accordance with a timing at which the sheet sensor 105 or 110 detects a front end or a back end of a sheet, but a sensor for detecting a sheet is not limited to this. For example, it may be so arranged that: sheet sensors are provided on a plurality of portions of the sheet transport path, and the control section 100 integrally uses detection signals of these sheet sensors so as to control transport of various kinds of sheets.

Further, in the present embodiment, the sheet transport interval is adjusted by causing the control section 100 to adjust a timing, at which the sheet is transported to the main transport path 22, in accordance with a detection signal of the sheet sensor 110 provided on the main transport path 22, but the process of adjusting the sheet transport interval is not limited to this.

Figure 14:
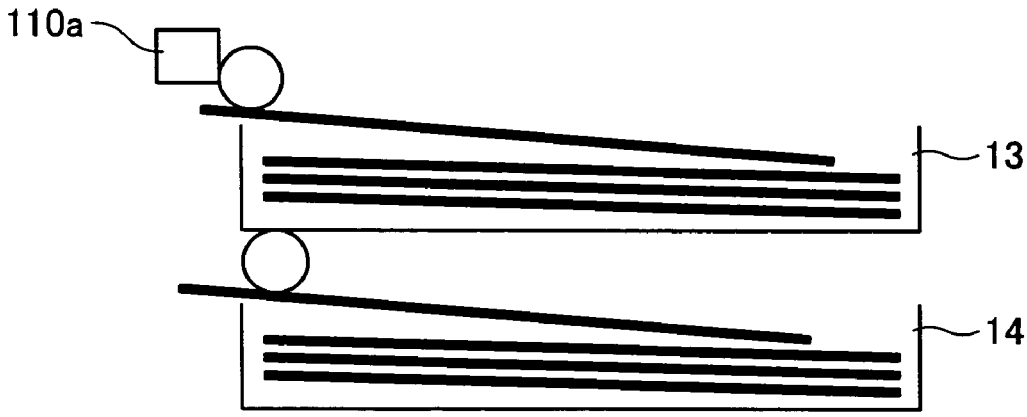
FIG. 14 is an explanatory drawing for illustrating another example of how the sheet transport interval is adjusted in the sheet transport device of the present invention.

For example, it may be so arranged that: a sheet sensor is provided on each of sheet feeding sections of a sheet feeding tray or a sheet feeding unit, and the control section 100 controls a timing at which a sheet is pulled out from the sheet feeding tray or the sheet feeding unit (a timing at which a sheet is fed). FIG. 14 shows an arrangement in which a sheet sensor 110*a* is provided on the sheet feeding section of the sheet feeding tray 13 shown in FIG. 3.

According to FIG. 14, in case of sequentially feeding sheets from the sheet feeding tray 13, a first normal sheet is fed and is detected by the sheet sensor 110*a*, and the first normal sheet is transported at a distance corresponding to L+D, and then a next normal sheet is fed so that a front end of the next normal sheet reaches a detection point of the sheet sensor 110*a*. Alternatively, it may be so arranged that: the sheet sensor 110*a* detects a back end of the first normal sheet, and the first normal sheet is transported at a distance corresponding to D, and then the next normal sheet is fed so that the front end of the next normal sheet reaches the detection point of the sheet sensor 110*a*.

Further, for example, it may be so arranged th at: a sheet sensor is provided on a sheet feeding section of the manual sheet feeding unit 18, and in case of sequentially feeding tab sheets from the manual sheet feeding unit 18, a front end of a first tab sheet is detected by the sheet sensor, and the first tab sheet is transported at a distance corresponding to L+T+D, and then a next tab sheet is fed so that a front end of the next tab sheet reaches a detection point of the sheet sensor.

Further, it may be so arranged that: sheet sensors are respectively provided on sheet feeding sections of the sheet feeding trays and the sheet feeding units, and in case of sequentially feeding sheets from the plural sheet feeding trays or the plural sheet feeding units, the control section 100 adjusts a timing at which the sheets are fed from the sheet feeding units so that transport intervals of the sheets are appropriate. In this case, it may be so arranged that: the control section 100 adjusts a timing at which the sheets are fed from the sheet feeding units in consideration for (i) a transport path length from each sheet sensor 110*a* to each section of the transport path and (ii) a transport speed thereof.

Further, it may be so arranged that: a plurality of sheet sensors are disposed in the sheet transport path of the sheet transporting mechanism 101, and the control section 100 controls a transport speed of each section of the sheet transporting mechanism 101 in accordance with detection signals of the sheet sensors. Alternatively, it may be so arranged that: the foregoing methods are combined with each other, and the control is carried out in accordance with thus combined methods. For example, two tab sheets are sequentially fed from the manual sheet feeding unit 18, and a normal sheet is fed from the sheet feeding tray 13, and the sheets are transported, at appropriate sheet feeding intervals, in a junction of the main transport path 22, the first transport path 15, and the second transport path 16, in an order of the first tab sheet, the normal sheet, and the second tab sheet.

Further, the sheet transporting mechanism 101 of the present embodiment is provided on the digital copying machine 1. However, the arrangement is not limited to this, and it is possible to apply the sheet transporting device 101 to various kinds of devices each of which transports tab sheets.

Further, in the present embodiment, an operation of the sheet transporting mechanism 101 is controlled by the control section 100 for controlling entire operations of the digital copying machine 1, but the arrangement is not limited to this. For example, it may be so arranged that a special control section for controlling the operation of the sheet transporting mechanism 101 is provided. That is, it may be so arranged that the sheet transporting mechanism 101 has a control section for controlling an operation of the sheet transporting mechanism 101 itself.

Further, in the present embodiment, the transport plan memory 45 for storing the transport plan table is provided on the digital copying machine 1, but the transport plan memory 45 may be provided on the sheet transporting mechanism 101 for example.

Further, in the digital copying machine 1, the multistage sheet feeding unit 3 includes: the first large volume sheet feeding tray 11 and the second large volume sheet feeding tray 12 that are disposed under the printer section 2 so as to be positioned in parallel to each other; and the first sheet feeding tray 13 and the second sheet feeding tray 14 that are disposed under the first large volume sheet feeding tray 11 and the second large volume sheet feeding tray 12. Further, sheets fed and transported from the sheet feeding trays 11, 12, 13, and 14 are transported via the first transport path (vertical path) 15 or the second transport path (horizontal path) 16, each of which is shared by the sheet feeding sections, to the transcription section. As apparent from FIG. 3, the first transport path (vertical path) 15 and the second transport path (horizontal path) 16 respectively extend in directions (in a vertical direction and in a horizontal direction) along a frame (structure frame) 17 of the multistage sheet feeding unit 3 (so as to be respectively positioned vertically in parallel to the frame 17 and horizontally in parallel to the frame 17). Thus, the plural sheet feeding trays 11, 12, 13, and 14 are efficiently disposed in a space of the multistage sheet feeding unit 3. Also under the printer section 2, the first transport path 15 and the second transport path 16, each of which is shared by the sheet feeding trays 11, 12, 13, 14, and plural sheet feeding sections, are stored in a minimum installation space. Note that, in case of setting sheets on the sheet feeding trays 11, 12, 13, and 14, each of the sheet feeding trays 11, 12, 13, and 14 is pulled out in a front direction of the digital copying machine 1 (front side in FIG. 3) so as to set the sheets therein. Note that, the sheet feeding trays 11 and 12 are installed on a single tray, and two sheet feeding sections are simultaneously moved by pulling the single tray out or pushing the single tray in.

In this arrangement, in case where a sheet stops in the first transport path (vertical path) 15, a common guide (shaded portion 15*a*) constituting the first transport path (vertical path) 15 is opened (rotated) to the front side by using a back side of the multistage sheet feeding unit 3 as a fulcrum. This operation is carried out by using a work space which has been provided on the left side of the first transport path (vertical path) 15 in advance.

Further, also in case where a sheet stops in the second transport path (horizontal path) 16, a common guide (shaded portion 16*a*) constituting the second transport path (horizontal path) 16 is opened (rotated) to the front side by using the back side of the multistage sheet feeding unit 3 as a fulcrum. By performing this operation, it is possible to easily remove the sheet stopping in the second transport path (horizontal path) 16. Note that, this operation is performed after preparing a work space under the second transport path (horizontal path) 16 by pulling out the first large volume sheet feeding tray 11 and the second large volume sheet feeding tray 12, that are disposed in parallel to each other, to the front side.

Note that, in the present embodiment, the first large volume sheet feeding tray 11 and the second large volume sheet feeding tray 12 can be pulled out as a single tray, but it may be so arranged that these trays can be separately pulled out. In this case, it is also possible to prepare a work space under the second transport path (horizontal path) 16 by pulling out the first large volume sheet feeding tray 11 to the front side.

Further, the first large volume sheet feeding tray 11 is made wider than the second large volume sheet feeding tray 12 as a unit. This arrangement is made in consideration for (i) size difference between sheets respectively stored in the first sheet feeding tray 11 and in the second sheet feeding tray 12 and (ii) a process of preparing an open work space with respect to the second transport path (horizontal path) 16.

That is, the size (width) of the first large volume sheet feeding tray 11 is made larger, so that the second transport path (horizontal path) 16 via which the sheet is transported from the second large volume sheet feeding tray 12 to the transcription section extends over the first large volume sheet feeding tray. As a result, the second transport path (horizontal path) 16 is long. Thus, even when the sheet stops in the second transport path (horizontal path) 16, it is possible to widely open the second transport path (horizontal path) 16. Further, even when a sheet transported from the second large volume sheet feeding tray 12 stops in the second transport path (horizontal path) 16, an open width of the second transport path (horizontal path) 16 is larger than a length of the sheet transported from the second large volume sheet feeding tray 12, so that it is possible to easily confirm (find) the sheet within a range of the opened second transport path (horizontal path) 16.

Further, as a transport path from the first large volume sheet feeding tray 11 to the transcription section, the first transport path (vertical path) 15 is used. This is based on the following reason: when a transport path to the transcription section is formed by forcedly using the second transport path (horizontal path) 16, a junction transport path positioned before the transcription section is complicated, so that a condition under which sheets are fed and transported from the first large volume sheet feeding tray 11 is unstable. Further, in case of using the second transport path (horizontal path) 16, it is necessary to perform the foregoing operation while opening the vicinity of the junction transport path in order to remove the sheet which stops due to unstable transport, so that this requires a troublesome work (in the worst case, the sheet is torn when pulling out the sheet, and the torn sheet remains in the transport path 16, so that this may cause any trouble). On the other hand, in case of using the first transport path (vertical path) 15, a part (shaded portion 15*a*) of the first transport path (vertical path) 15 is widely opened so as to remove the sheet which stops due to unstable transport, thereby easily removing the sheet stopping in the first transport path (vertical path) 15.

Further, the manual sheet feeding unit 18 storing a relatively small amount of sheets and the large volume sheet feeding unit 20 are provided on the downstream side with respect to the second transport path (horizontal path) 16.

It is often that special sheets (sheets different from each other in terms of characteristics such as a material, a shape, and the like) are set in the manual sheet feeding unit 18. This is because it is easy to replace and set sheets with respect to a tray. Thus, sheets set in the manual sheet feeding tray 18 are more likely to be unstable in terms of the sheet transport than sheets set in other sheet feeding trays (sheet feeding sections) 11, 12, 13, and 14. Particularly, in case where a sheet exceeding a certain limit (recommended sheet range) is set, this is highly likely to cause the unstable transport.

Then, although not shown, the manual sheet feeding unit 18 is supported by a guiding rail or the like provided on a frame of the digital copying machine 1 so that both ends of the manual sheet feeding unit 18 can slide in a horizontal direction with respect to the sheet transporting direction. The manual sheet feeding unit 18 is drawn in a right direction from the right side of the digital copying machine 1, so that a transport path from the manual sheet feeding unit 18 to the second transport path (horizontal path) 16 is widely opened. Further, after removing the stopping sheet, it is possible to easily restore the digital copying machine 1 into an operable state.

Note that, the manual sheet feeding unit 18 may be provided as a separate optional device. For example, the manual sheet feeding unit 18 may be installed at the time of production/shipment of the digital copying machine 1 as required in market, or may be added as a system selected by a user.

Further, a sheet fed from the large volume sheet feeding unit 20 connected to a right side of the multistage sheet feeding unit 3 is led from the transport path 19 via the second transport path (horizontal path) 16 to the transcription section.

In this manner, according to the present invention, a front end of a sheet is detected, so that it is possible to appropriately adjust a timing for switch back and a sheet transport interval irrespective of a shape of a back end of the sheet. Thus, it is possible to apply the present invention to various devices each of which transports sheets.

As described above, the sheet transporting device according to the present invention may be arranged so that: in case of sequentially transporting a plurality of sheets, when the sheets include one or more tab sheets, the sheet transport is controlled in accordance with a timing at which the sheet detection section detects a front end of each of the sheets, and when the sheets include no tab sheet, the sheet transport is controlled in accordance with a timing at which the sheet detection section detects a back end of each of the sheets.

In this case, when sequentially transporting a plurality of sheets including any tab sheets, the sheet transport is controlled always in accordance with a timing at which a front end of the sheet is detected irrespective of whether the sheet is a tab sheet or a normal sheet, and when sequentially transporting the sheets including no tab sheet, the sheet transport is controlled in accordance with a timing at which a back end of the sheet is detected.

Thus, in case of transporting a plurality of sheets including any tab sheets, it is possible to appropriately control the sheet transport also with respect to plural kinds of tab sheets different from each other in terms of a tab position in a vertical direction with respect to a transporting direction without providing a plurality of sheet detection sections. Further, in case of transporting a plurality of sheets including no tab sheet, the sheet transport is controlled in accordance with a timing at which the sheet detection section detects a back end of a normal sheet, thereby improving the accuracy in controlling the sheet transport. That is, it is possible to provide a sheet transporting device which can appropriately control the sheet transport also with respect to plural kinds of tab sheets different from each other in terms of a tab position in a vertical direction with respect to the transporting direction without increasing the cost, and it is possible to improve the accuracy in controlling the sheet transport in case where only normal sheets are transported.

Further, a single timing in accordance with which the sheet transport is controlled is determined on the basis of whether the transported plural sheets include any tab sheet or not, so that it is possible to control the sheet transport with a simple arrangement. Further, as the timing in accordance with which the sheet transport is controlled, either a timing at which a front end of the sheet is detected or a timing at which a back end of the sheet is detected is selected, so that the accuracy in controlling the sheet transport is uniformed. As a result, it is possible to stabilize an operation of the sheet transport.

Further, the sheet transporting device according to the present invention is arranged so as to include a sheet reversing section which carries out switch back for reversing the transporting direction of the sheet so as to reverse and transport the sheet, wherein a timing for the switch back is controlled in controlling the sheet transport.

In case of carrying out the reversal transport, it is possible to appropriately control the timing for the switch back also with respect to plural kinds of tab sheets different from each other in terms of a tab position in a vertical direction with respect to the sheet transporting direction without providing a plurality of sheet detection sections in a vertical direction with respect to the sheet transporting direction. That is, it is possible to provide a sheet transporting device which can appropriately control the timing for the switch back also with respect to plural kinds of tab sheets different from each other in terms of a tab position in a vertical direction with respect to the transporting direction without increasing the cost.

Further, the sheet transporting device according to the present invention may be arranged so that: in case where the sheet is the tab sheet and the tab sheet is reversed and transported, the timing for the switch back is controlled in accordance with the timing at which the sheet detection section detects the front end of the tab sheet, and in case where the sheet is a normal sheet and the normal sheet is reversed and transported, the timing for the switch back is controlled in accordance with a timing at which the sheet detection section detects a back end of the normal sheet, and in case of reversing and transporting the tab sheet, the timing for the switch back is controlled so that a time taken to carry out the switch back after a back end of the tab sheet has passes through a detection point of the sheet detection section is longer than a time taken to carry out the switch back after the back end of the normal sheet has been detected by the sheet detection section.

In case of controlling the timing for the switch back in accordance with a timing at which a front end of the sheet is detected, the sheet sliding or a similar trouble may occur while the sheet is being transported from a position in which its front end is detected by the sheet detection section to a position in which its back end is detected. Thus, the accuracy may be lower than the case of controlling the timing for the switch back in accordance with a timing at which a back end of the sheet is detected.

According to the foregoing invention, the timing for the switch back is controlled so that a time take to carry out the switch back after a back end of a tab of the tab sheet has passed through a detection point of the sheet detection section is longer than a time to carry out the switch back after a back end of a normal sheet has been detected by the sheet detection section in case of reversing and transporting the normal sheet. Thus, it is easier to obtain a transport path required in preventing the sheet transport trouble, so that it is possible to suppress the sheet transport trouble such as the simultaneous transport of plural sheets.

Further, the sheet transporting device according to the present invention may be arranged so as to include a transport interval adjustment section for adjusting a sheet transport interval which is an interval between the transported sheets, wherein the sheet transport interval is controlled by the sheet transport interval adjustment section in controlling the sheet transport.

In this case, it is possible to appropriately control the sheet transport interval also with respect to plural kinds of tab sheets different from each other in terms of a tab position in a vertical direction with respect to the sheet transporting direction without providing a plurality of sheet detection sections in a vertical direction with respect to the sheet transporting direction. That is, it is possible to provide a sheet transporting device which can appropriately control the sheet transport interval also with respect to plural kinds of tab sheets different from each other in terms of a tab position in a vertical direction with respect to the transporting direction without increasing the cost.

Further, the sheet transporting device according to the present invention may be arranged so that: the sheet transport interval is controlled in accordance with (i) a timing at which the sheet detection section detects the font end of the tab sheet and (ii) a timing at which the sheet detection section detects the back end of the normal sheet, and a sheet transport interval between the tab sheet and a sheet transported right after the tab sheet is made wider than a sheet transport interval between the normal sheet and a sheet transported right after the normal sheet.

In case of controlling the sheet transport interval in accordance with the timing at which the front end of the sheet is detected, the sheet sliding or a similar trouble may occur while the sheet is being transported from a position in which its front end is detected by the sheet detection section to a position in which its back end is detected by the sheet detection section. Thus, the accuracy may be lower than the case of controlling the timing for the switch back in accordance with a timing at which a back end of the sheet is detected.

According to the foregoing invention, the sheet transport interval between the tab sheet and a sheet transported right after the tab sheet is made wider than the sheet transport interval between the normal sheet and a sheet transported right after the normal sheet. Thus, even in case of controlling the sheet transport interval in accordance with a timing at which a front end of the tab sheet is detected, it is easier to obtain a transport path required in preventing the sheet transport trouble, so that it is possible to suppress the sheet transport trouble such as the simultaneous transport of plural sheets and the sheet jam.

Further, the sheet transporting device according to the present invention may be arranged so as to include a transport plan storage section for storing a transport plan table to manage information concerning the sheet transport, wherein a kind of a transported sheet is determined in accordance with the transport plan table.

Here, examples of the information concerning the sheet transport which is managed in the transport plan table include: where a sheet is fed; where the sheet is discharged; a size of the sheet; a kind of the sheet; how an image is processed; and the like.

A kind of the sheet is determined in accordance with such transport plan table, so that it is possible to appropriately determine whether a transported sheet is a tab sheet or a normal sheet.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A sheet transporting device, comprising:

a sheet detection section for detecting that each of transported sheets reaches a specific position; and a control section that controls the sheet transport, wherein when transporting a tab sheet, the tab sheet is transported so that its end having a tab is a back end of the tab sheet in a transporting direction, and the control section controls the sheet transport in accordance with a timing at which the sheet detection section detects a front end of the tab sheet to account for the additional time it takes to pass a tab width through the sheet detection section, and when sequentially transporting a plurality of sheets, when the sheets include one or more tab sheets, the control section controls the sheet transport in accordance with a timing at which the sheet detection section detects a front end of each of the sheets without taking account of a timing at which a back end of each of the sheets is detected, irrespective of whether the sheet is a tab sheet or a normal sheet, and when the sheets include no tab sheet, the control section controls the sheet transport in accordance with a timing at which the sheet detection section detects a back end of each of the sheets without taking account of a timing at which the front end of each of the sheets is detected.

2. The sheet transporting device as set forth in claim 1, wherein a speed at which the sheet is transported is controlled, or a transport interval between the sheets sequentially transported is controlled, or switching of a transport path in which the sheet is transported is controlled, in controlling the sheet transport.

3. The sheet transporting device as set forth in claim 1, wherein the sheet detection section is provided on a sheet transport path in which the sheet is transported.

4. The sheet transporting device as set forth in claim 1, wherein when transporting a normal sheet, the sheet transport is controlled in accordance with a timing at which the sheet detection section detects a back end of the normal sheet.

5. The sheet transporting device as set forth in claim 1, further comprising a sheet reversing section which carries out switch back for reversing the transporting direction of the sheet so as to reverse and transport the sheet, wherein a timing for the switch back performed by the sheet reversing section is controlled in controlling the sheet transport.

6. The sheet transporting device as set forth in claim 5, wherein when the sheet is the tab sheet and the tab sheet is reversed and transported, the timing for the switch back is controlled in accordance with the timing at which the sheet detection section detects the front end of the tab sheet, and when the sheet is a normal sheet and the normal sheet is reversed and transported, the timing for the switch back is controlled in accordance with a timing at which the sheet detection section detects a back end of the normal sheet, and when reversing and transporting the tab sheet, the timing for the switch back is controlled so that a time taken to carry out the switch back after a back end of the tab sheet has passes through a detection point of the sheet detection section is longer than a time taken to carry out the switch back after the back end of the normal sheet has been detected by the sheet detection section.

7. The sheet transporting device as set forth in claim 1, further comprising a transport interval adjustment section for adjusting a sheet transport interval which is an interval between the transported sheets, wherein the sheet transport interval is controlled by the sheet transport interval adjustment section in controlling the sheet transport.

8. The sheet transporting device as set forth in claim 7, wherein the sheet transport interval is controlled in accordance with (i) a timing at which the sheet detection section detects the font end of the tab sheet and (ii) a timing at which the sheet detection section detects a back end of a normal sheet, and a sheet transport interval between the tab sheet and a sheet transported right after the tab sheet is made wider than a sheet transport interval between the normal sheet and a sheet transported right after the normal sheet.

9. The sheet transporting device as set forth in claim 1, further comprising a transport plan storage section for storing a transport plan table to manage information concerning the sheet transport, wherein a kind of a transported sheet is determined in accordance with the transport plan table.

10. An image recording device, comprising:

a sheet transporting device; and a control section that controls the sheet transport, wherein the sheet transporting device includes a sheet detection section for detecting that each of transported sheets reaches a specific position, when transporting a tab sheet, the tab sheet is transported so that its end having a tab is a back end of the tab sheet in a transporting direction, and the control section controls the sheet transport in accordance with a timing at which the sheet detection section detects a front end of the tab sheet to account for the additional time it takes to pass a tab width through the sheet detection section, and when sequentially transporting a plurality of sheets, when the sheets include one or more tab sheets, the control section controls the sheet transport in accordance with a timing at which the sheet detection section detects a front end of each of the sheets without taking account of a timing at which a back end of each of the sheets is detected, irrespective of whether the sheet is a tab sheet or a normal sheet, and when the sheets include no tab sheet, the control section controls the sheet transport in accordance with a timing at which the sheet detection section detects a back end of each of the sheets without taking account of a timing at which the front end of each of the sheets is detected.

11. An image recording device, provided with a sheet transporting device for transporting sheets, said image recording device comprising:

a sheet detection section for detecting that each of transported sheets reaches a specific position; and a control section for controlling sheet transport in accordance with a timing at which the sheet detection section detects the sheet, wherein:

when the sheet is a tab sheet, the sheet transporting device transports the tab sheet so that its end having a tab is a back end of the tab sheet in a transporting direction, and the control section controls the sheet transport in accordance with a timing at which the sheet detection section detects a front end of the tab sheet to account for the additional time it takes to pass a tab width through the sheet detection section, and when sequentially transporting a plurality of sheets, when the sheets include one or more tab sheets, the control section controls the sheet transport in accordance with a timing at which the sheet detection section detects a front end of each of the sheets without taking account of a timing at which a back end of each of the sheets is detected, irrespective of whether the sheet is a tab sheet or a normal sheet, and when the sheets include no tab sheet, the control section controls the sheet transport in accordance with a timing at which the sheet detection section detects a back end of each of the sheets without taking account of a timing at which the front end of each of the sheets is detected.

12. The image recording device as set forth in claim 11, wherein the control section controls a speed at which the sheet is transported, or a transport interval between the sheets sequentially transported, or switching of a transport path in which the sheet is transported, in controlling the sheet transport.

13. The image recording device as set forth in claim 11, wherein the sheet detection section is provided on a sheet transport path of the sheet transporting device in which the sheet is transported.

14. The image recording device as set forth in claim 11, further comprising a sheet feeding section for feeding the sheets, wherein the sheet detection section is provided on the sheet feeding section.

15. The image recording device as set forth in claim 11, wherein when the sheet is a normal sheet, the control section controls the sheet transport in accordance with a timing at which the sheet detection section detects a back end of the normal sheet.

16. The image recording device as set forth in claim 11, further comprising a sheet reversing section which carries out switch back for reversing the transporting direction of the sheet so as to reverse and transport the sheet, wherein the control section controls a timing for the switch back carried out by the sheet reversing section in accordance with a timing at which the sheet detection section detects the sheet.

17. The image recording device as set forth in claim 16, wherein when the sheet is the tab sheet, the control section controls the timing for the switch back carried out by the sheet reversing section in accordance with a timing at which the sheet detection section detects a back end of a tab of the tab sheet.

18. The image recording device as set forth in claim 17, wherein when the sheet is a normal sheet, the control section controls the timing for the switch back carried out by the sheet reversing section in accordance with a timing at which the sheet detection section detects a back end of the normal sheet.

19. The image recording device as set forth in claim 18, wherein when the sheet is the tab sheet, the control section controls the timing for the switch back carried out by the sheet reversing section so that a time taken to carry out the switch back after the sheet detection section has detected the back end of the tab sheet is longer than a time taken to carry out the switch back after the sheet detection section has detected the back end of the normal sheet.

20. The image recording device as set forth in claim 16, wherein the control section controls the timing for the switch back carried out by the sheet reversing section so that the switch back is carried out by the sheet reversing section after a predetermined time passes since a timing at which the sheet detection section has detected the sheet.

21. The image recording device as set forth in claim 20, wherein the control section controls the timing for the switch back carried out by the sheet reversing section so that the predetermined time when the sheet is the tab sheet is equal to the predetermined time when the sheet is the normal sheet.

22. The image recording device as set forth in claim 20, wherein the control section controls the timing for the switch back carried out by the sheet reversing section so that the predetermined time when the sheet is the tab sheet is longer than the predetermined time when the sheet is the normal sheet.

23. The image recording device as set forth in claim 11, wherein the sheet transporting device sequentially transports the sheets, and the sheet transporting device further includes a transport interval adjustment section for adjusting a sheet transport interval which is an interval between the transported sheets, and the control section causes the sheet transport interval adjustment section to control the sheet transport interval.

24. The image recording device as set forth in claim 23, wherein the control section causes the transport interval adjustment section to adjust the sheet transport interval in accordance with a timing at which the sheet detection section detects a front end of each of the sheets that are sequentially transported.

25. The image recording device as set forth in claim 23, wherein when a previously transported sheet out of the sheets sequentially transported is the tab sheet, the control section causes the transport interval adjustment section to adjust the sheet transport interval so that a sheet transport interval between a back end of the tab sheet and a front end of a sheet transported right after the tab sheet is not less than a predetermined interval.

26. The image recording device as set forth in claim 25, wherein when a previously transported sheet out of the sheets sequentially transported is the normal sheet, the control section causes the transport interval adjustment section to adjust the sheet transport interval so that a sheet transport interval between a back end of the normal sheet and a front end of a sheet transported right after the tab sheet is not less than a predetermined interval.

27. The image recording device as set forth in claim 26, wherein the control section causes the transport interval adjustment section to adjust the sheet transport interval so that the predetermined interval when the previously transported sheet is the tab sheet is equal to the predetermined interval when the previously transported sheet is the normal sheet.

28. The image recording device as set forth in claim 26, wherein the control section causes the transport interval adjustment section to adjust the sheet transport interval so that the predetermined interval when the previously transported sheet is the tab sheet is larger than the predetermined interval when the previously transported sheet is the normal sheet.

29. The image recording device as set forth in claim 11, further comprising a transport plan storage section for storing a transport plan table to manage information concerning the sheet transport, wherein the control section determines a kind of the transported sheet in accordance with the transport plan table.

30. A method for transporting sheets while controlling sheet transport, said method comprising the steps of:

transporting a tab sheet as each of the sheets so that its end having a tab is a back end of the tab sheet in a transporting direction; and controlling the sheet transport in accordance with a timing at which a sheet detection section for detecting that each of the sheets transported reaches a specific position detects a front end of the tab sheet, wherein when sequentially transporting a plurality of sheets, when the sheets include one or more tab sheets, controlling the sheet transport in accordance with a timing at which the sheet detection section detects a front end of each of the sheets without taking account of a timing at which a back end of each of the sheets is detected, irrespective of whether the sheet is a tab sheet or a normal sheet, and when the sheets include no tab sheet, controlling the sheet transport in accordance with a timing at which the sheet detection section detects a back end of each of the sheets without taking account of a timing at which the front end of each of the sheets is detected.

31. The method as set forth in claim 30, wherein when transporting a normal sheet as the sheet, the sheet transport is controlled in accordance with a timing at which the detection section detects a back end of the normal sheet.

* * * * *